US006161912A

United States Patent [19]

Kitahara et al.

[11] Patent Number: 6,161,912

[45] Date of Patent: Dec. 19, 2000

[54] METHOD OF MAINTAINING AND CONTROLLING THE HELMHOLTZ RESONANT FREQUENCY IN AN INK JET PRINT HEAD

[75] Inventors: Tsuyoshi Kitahara; Ryoichi Tanaka, both of Nagano, Japan

[73] Assignee: Seiko Epson Corporation, Tokyo, Japan

[21] Appl. No.: 08/981,148

[22] PCT Filed: Apr. 10, 1997

[86] PCT No.: PCT/JP97/01238

§ 371 Date: Dec. 10, 1997

§ 102(e) Date: Dec. 10, 1997

[87] PCT Pub. No.: WO97/37852

PCT Pub. Date: Oct. 16, 1997

[30] Foreign Application Priority Data

| | | | |
|---|---|---|---|
| Apr. 10, 1996 | [JP] | Japan | 8-088464 |
| Apr. 10, 1996 | [JP] | Japan | 8-088468 |
| Oct. 15, 1996 | [JP] | Japan | 8-272742 |

[51] Int. Cl.[7] ..... B41J 29/38

[52] U.S. Cl. ..... 347/9; 347/10

[58] Field of Search ..... 347/9, 10, 11, 347/68–72

[56] References Cited

U.S. PATENT DOCUMENTS

| | | | |
|---|---|---|---|
| 4,593,291 | 6/1986 | Howkins | 346/1.1 |
| 5,014,708 | 5/1991 | Hayashi et al. . | |
| 5,088,492 | 2/1992 | Takayama et al. . | |
| 5,429,133 | 7/1995 | Thurston et al. . | |
| 5,495,270 | 2/1996 | Burr et al. | 347/10 |
| 5,736,993 | 4/1998 | Regimbal et al. | 347/11 |
| 5,764,256 | 6/1998 | Zhang | 347/10 X |
| 5,933,168 | 8/1999 | Sakai | 347/10 X |

FOREIGN PATENT DOCUMENTS

| | | | |
|---|---|---|---|
| 0 575 204 A2 | 12/1993 | European Pat. Off. | B41J 2/04 |
| 0 738 602 | 10/1996 | European Pat. Off. | B41J 2/045 |
| 1-130949 | 5/1989 | Japan | B41J 3/04 |
| 4-36071 | 6/1992 | Japan | B41J 2/045 |
| 6-40031 | 2/1994 | Japan | B41J 2/045 |
| 7-178926 | 7/1995 | Japan | B41J 2/175 |
| WO94/03108 | 2/1994 | WIPO . | |

OTHER PUBLICATIONS

European Search Report, Sep. 9, 1999.

*Primary Examiner*—John Barlow
*Assistant Examiner*—C Dickens
*Attorney, Agent, or Firm*—Sughrue, Mion, Zinn, Macpeak & Seas, PLLC

[57] ABSTRACT

A method of driving an ink-jet recording head which is provided with nozzle openings, pressure generating chambers each communicating with reservoirs via ink supply ports and keeping the Helmholtz resonance frequency with a period Tc, and piezo-electric vibrators for expanding and contracting the respective pressure generating chambers. The method of driving the ink-jet recording head comprises a first step of expanding the pressure generating chamber, a second step of maintaining the expanded condition, and a third step of causing an ink droplet to be jetted from the nozzle opening by contracting the pressure generating chamber thus expanded. The duration of the second step is set not greater than ½ of the period Tc of the Helmholtz resonance vibration in order to prevent the generation of satellites and ink mists resulting from the swollen-back meniscus by minimizing the meniscus vibration, so that the driving at a high driving frequency is made possible by shorting the attenuation time of the meniscus corresponding to its reduced vibration.

75 Claims, 13 Drawing Sheets

FIG. 4 (III)

FIG. 10 (III)

FIG. 17 (III)

METHOD OF MAINTAINING AND CONTROLLING THE HELMHOLTZ RESONANT FREQUENCY IN AN INK JET PRINT HEAD

TECHNICAL FIELD

The present invention relates to a driving technique for an ink-jet recording head using piezo-electric vibrators as actuators in order to obtain images of substantially the same degree of print quality as photographs by means of extremely small ink droplets.

BACKGROUND ART

An ink-jet recording head is usable for printing color images by preparing ink of more than one color. However, it is essential to minimize the quantity of ink in the form of an ink droplet in order to reduce the size of each dot itself and to prevent ink from oozing out of the adjoining dots when an attempt is made to print images of substantially the same degree of print quality as photographs.

As Japanese Patent Publication No. Hei. 4-36071 discloses a method of technically forming very small dots by means of an ink-jet recording head through the steps of, as shown in FIG. 19, using a first signal S1 for rapidly expanding a pressure generating chamber so as to cause a meniscus to generate the Helmholtz resonance vibration by rapidly pulling back the meniscus from a nozzle opening, causing an ink droplet to be jetted by separating a part of the meniscus with kinetic energy originating from the energy of the Helmholtz resonance vibration, using a second signal S2 which maintains a substantially constant voltage for causing the meniscus to generate free vibration, and then using a third signal S3 for resetting the meniscus to a position where an ink droplet is properly jetted next time.

The aforementioned method will be described by reference to FIG. 20.

FIG. 20 shows a state of the meniscus after an ink droplet fit for printing is jetted because of the first signal S1 with the period Tc of the Helmholtz resonance vibration as a time unit, wherein a reference symbol M denotes the displacement of the meniscus on which the Helmholtz resonance vibration is superposed; and M', the displacement of the meniscus itself vibrated with an extremely long period Tm.

When the first signal S1 is set to a time period shorter than the period Tc of the Helmholtz resonance vibration, the Helmholtz resonance vibration is put in an active state of the Helmholtz resonance vibration, so that the Helmholtz resonance vibration with the period Tc is generated on the meniscus. This Helmholtz resonance vibration is generated in such a state that it has been superposed on the natural vibration M' of the meniscus displaced with the period Tm. When the natural vibration M' of the meniscus itself is brought close to the nozzle opening, a part of the meniscus is greatly swollen from the nozzle opening because of peaks of the Helmholtz resonance vibration P1', P2', P3' . . . and that part is isolated in the form of a very small ink droplet, that is, in the form of a satellite or an ink mist. The satellite or the ink mist conspicuously appears in an high-temperature environment as the viscosity of ink lowers.

An object of the present invention intended to solve the foregoing problems is to propose a method of driving an ink-jet recording head capable of discharging an ink droplet fit for the formation of a very small dot at a high driving frequency with the minimized quantity of ink without causing the generation of a very small useless ink droplet after the ink droplet is jetted.

DISCLOSURE OF THE INVENTION

According to the present invention, a method of driving an ink-jet recording head comprising nozzle openings, pressure generating chambers each communicating with reservoirs via ink supply ports and keeping the Helmholtz resonance frequency with a period Tc, and piezo-electric vibrators for expanding and contracting the respective pressure generating chambers, is such that an ink droplet fit for printing is jetted by generating vibration at the Helmholtz resonance frequency. The driving method preferably comprises the steps of firstly expanding the pressure generating chamber, secondly maintaining the expanded condition, and thirdly causing an ink droplet to be jetted from the nozzle opening by contracting the pressure generating chamber thus expanded, whereby the generation of a satellite or an ink mist resulting from a swollen-back meniscus is prevented by minimizing meniscus vibration. Thus, meniscus attenuating time is shortened by minimizing the meniscus vibration in order to make a printing operation performable at a high driving frequency.

BRIEF DESCRIPTION OF THE DRAWINGS

FIG. 18(*b*) is a chart showing the displacement of the meniscus when the first-to third signals are applied.

FIG. 18(*c*) is a chart showing the displacement of the meniscus when the first-to-fifth signals are applied.

FIG. 18(*d*) is a chart showing the displacement of the meniscus by means of the conventional driving method.

BEST MODE FOR CARRYING OUT THE INVENTION

A detailed description will subsequently be given of embodiments of the present invention with reference to the accompanying drawings.

Figure 1:
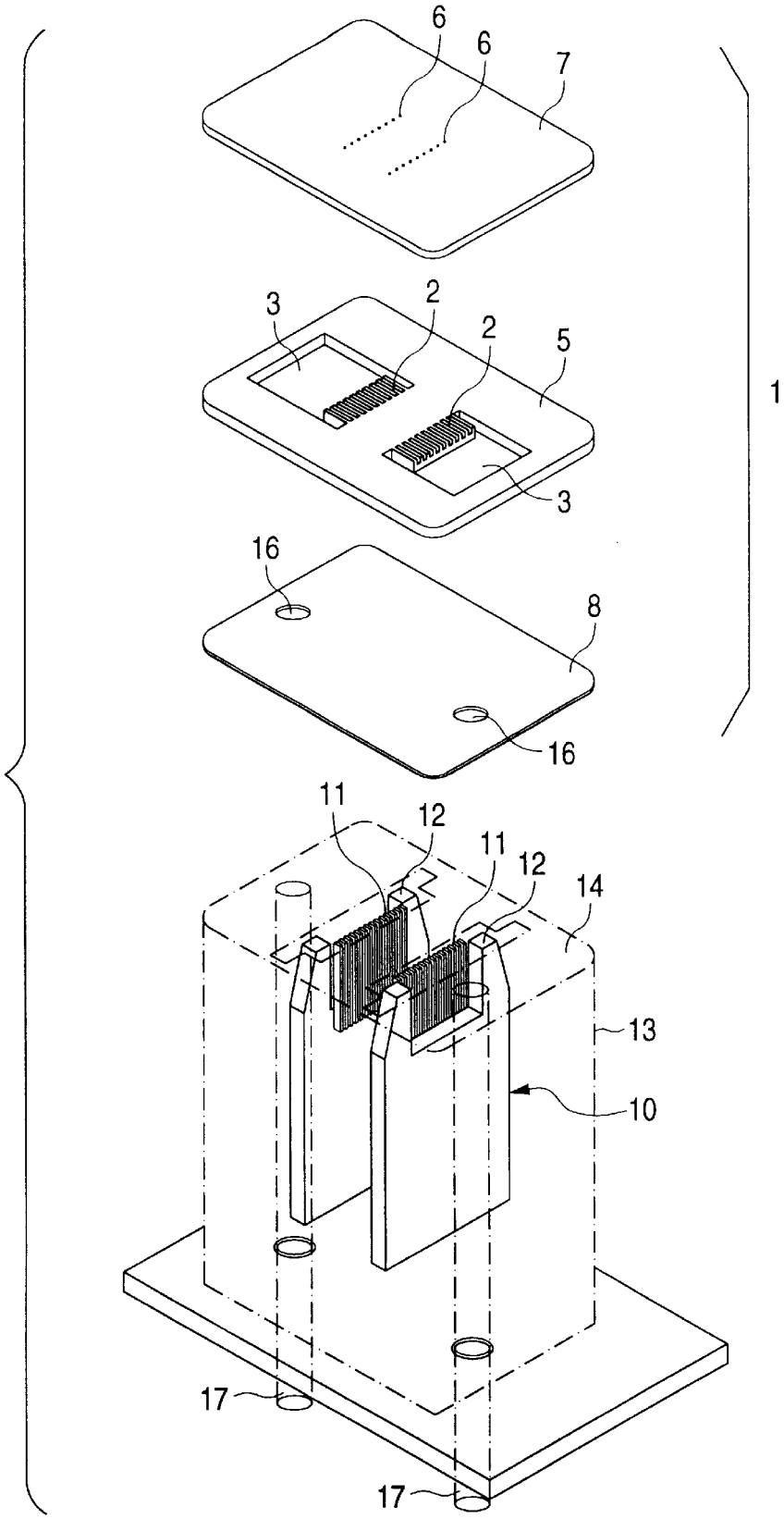
FIG. 1 is a perspective assembly drawing of an ink-jet recording head embodying the present invention.
Figure 2:
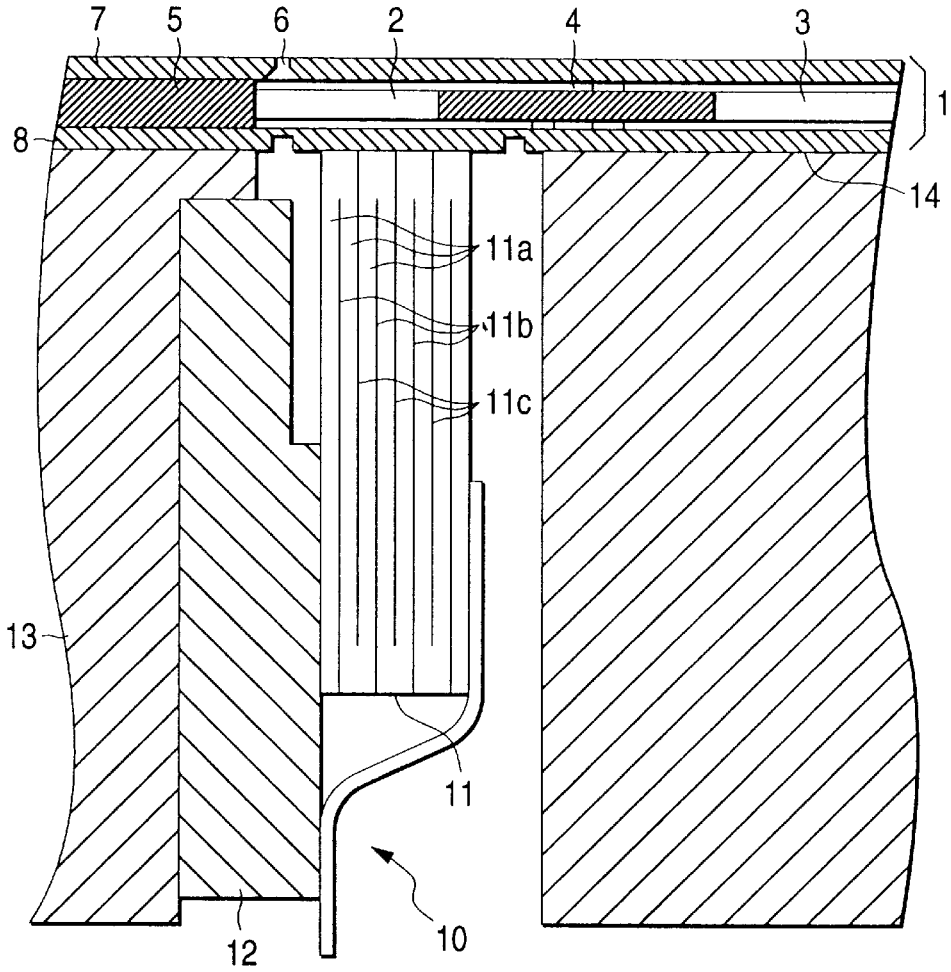
FIG. 2 is a sectional view showing the structure of the ink-jet recording head above.

FIGS. 1 and 2 show an embodiment of an ink-jet recording head for use in the present invention, wherein an ink flow channel unit 1 comprises pressure generating chambers 2, reservoirs 3, a spacer 5 for forming an ink supply port 4, a nozzle plate 7 which is provided with nozzle openings 6 communicating with the pressure generating chambers 2, an elastic plate 8 which is subjected to elastic deformation on receiving the displacement of piezo-electric vibrators which will be described later, and a spacer 5 whose surface and undersurface are sealed up with the nozzle plate 7 and the elastic plate 8, respectively.

A pressure generating unit 10 is formed so that piezo-electric vibrators 11 capable of elongating and contracting in a direction perpendicular to the face of the elastic plate 8 are firmly secured to fixed boards 12 in a displaceable state, the piezo-electric vibrators 11 being arranged in conformity with the arranging pitch of the pressure generating chambers 2.

In this embodiment, each the piezo-electric vibrator 11 is formed by laminating alternately a piezo-electric material 11*a*, a conductive material 11*b* and a conductive material 11*c* in parallel with a direction of expansion thereof. In the piezo-electric vibrator 11, the conductive material 11*b* and the conductive material 11*c* are served as different poles. The piezo-electric vibrator 11 is of a so-called vertical vibration mode that when charged, contracts at right angles to the conductive layer laminating direction, and when the charged condition changes to a discharged condition, expands at right angles to the conductive layers.

Further, in order to form the ink-jet recording head, the ink flow channel unit 1 is firmly secured to the upper end 14 of a holder 13, and the pressure generating unit 10 is brought into contact with the elastic plate 8 in such a manner that the front ends of the piezo-electric vibrators 11 are set opposite to the respective pressure generating chambers 2. Furthermore, the fixed boards 12 are firmly secured to the holder 13. Incidentally, reference numerals 16, 16 denote through-holes for use in connecting the reservoirs 3, 3 to ink-supply flow channels 17, 17 connected to an external ink container.

When a signal for making voltage rise temporarily is applied to the piezo-electric vibrators 11 in the ink-jet recording head thus constructed, the piezo-electric vibrators 11 are charged and contracted with the passage of time, and the contraction causes the elastic plate 8 to undergo elastic deformation so that it is separated from the spacer 5 with the effect of expanding the pressure generating chambers 2. As the pressure generating chambers 2 expand, ink in the reservoirs 3 are made to flow into the pressure generating chambers 2 via the ink supply port 4 and a meniscus formed in each of the nozzle openings 6 is drawn toward the pressure generating chamber side. When the signal is held at a predetermined level, the meniscus vibrates so as to move back and forth between the nozzle opening 6 and the pressure generating chamber 2 with its own natural vibration period.

When the charge of the piezo-electric vibrator 11 is discharged in such a state that piezo-electric vibrator 11 has fully been charged, the piezo-electric vibrator 11 temporarily elongates and reduces the volume of the pressure generating chamber 2 by pushing back the elastic plate 8 toward the spacer side. As the pressure generating chamber 2 contracts, ink in the pressure generating chamber 2 is pressurized, so that the meniscus in the vibrating state is pushed back toward the nozzle opening 6.

In the ink-jet recording head thus constructed, given that fluid compliance originating from compressibility of ink in the pressure generating chamber 2 is Ci; rigidity compliance due to the material itself of the elastic plate 8, the nozzle plate 7 and so forth used to form the pressure generating chamber 2 is Cv; the inertance of the nozzle opening 6 is Mn; and the inertance of the ink supply port 4 is MS, the frequency f of the Helmholtz resonance vibration of the pressure generating chamber 2 is shown by the following equation:

$$f=\tfrac{1}{2\pi}\times\sqrt{\{(Mn+MS)/(Mn\times MS)(Ci+Cv)\}}$$

Given that the compliance of the meniscus is Cn, further, the natural vibration period Tm of the meniscus is shown by the following equation:

$$Tm=2\pi\times\{\sqrt{(Mn+MS)Cn}\}$$

Given that the volume of the pressure generating chamber 2 is V; the density of ink is ρ; and the velocity of sound in ink is c, the fluid compliance Ci is shown by the following equation:

$$Ci=V/\rho c2.$$

The rigidity compliance Cv of the pressure generating chamber 2 conforms to the static deformation ratio of the pressure generating chamber 2 when unit pressure is applied to the pressure generating chamber 2.

When the ink-jet recording head is so constructed as to have the following properties: the fluid compliance $Ci=5\times10^{-21}(m^{5/N})$; the rigidity compliance $Cv=5\times10^{-21}(m^{5/N})$; the inertance Mn of the nozzle opening 6, $=1\times10^{8}(Kg/m^{4})$; and the inertance MS of the nozzle opening 6, $=1\times10^{8}(Kg/m^{4})$;

the ink-jet recording head generates a Helmholtz resonance vibration with a period of Tc=4.4 μs (225 kHz) in a case where the Helmholtz resonance vibration is superposed on the meniscus due to the expansion and contraction of the piezo-electric vibrator 11.

In order to obtain the driving characteristics like this, the space is formed with extremely small precise flow channels by etching single crystal silicon having a high elastic modulus, whereby the rigidity compliance Cv of the pressure generating chamber 2 can be reduced and the period Tc of the Helmholtz resonance vibration can also easily be decreased to 10 μs or less.

Further, though not only a spacer having the aforementioned properties but also piezo-electric vibrators with extremely high response capability are needed to make jet of ink droplets of 10 ng or smaller according to the present invention, the pressure generating chamber 2 can be expanded and contracted in a shorter time than the natural vibration period of the piezo-electric vibrator 11 since the piezo-electric vibrator 11 of the vertical vibration mode which is constructed as described above is accurately displaced in response to the signal applied.

A description will subsequently be given of a driving method as a first embodiment of the present invention for causing a smaller quantity of ink in the form of an ink droplet having velocity fit for printing to be jetted from the ink-jet recording head thus constructed.

Figure 3:
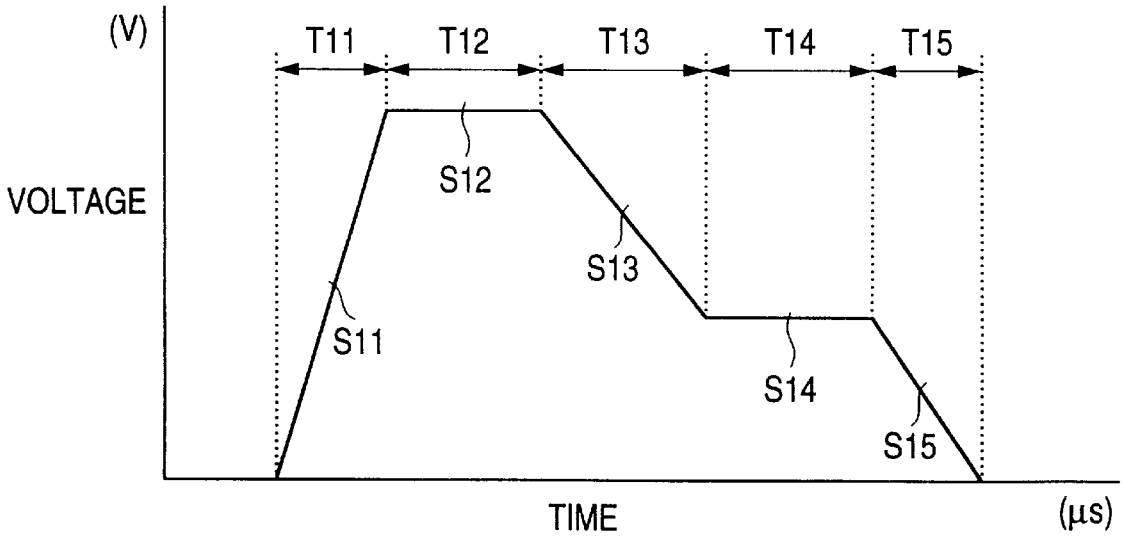
FIG. 3 is a signal waveform chart showing a method of driving an ink-jet recording head as a first embodiment of the present invention.
Figure 4:
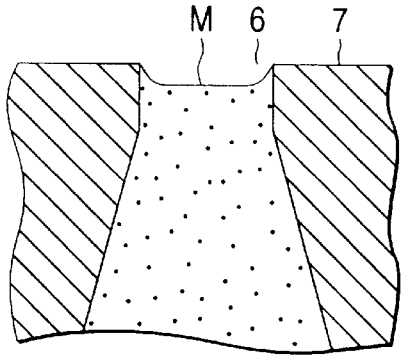
FIGS. 4(I)–(VI) show the behavior of meniscuses by means of the driving method according to the first embodiment of the present invention, respectively.
Figure 4:
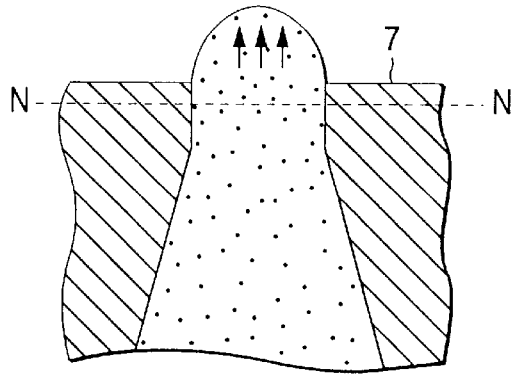
Figure 4:
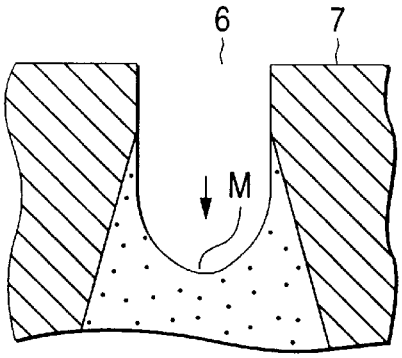
Figure 4:
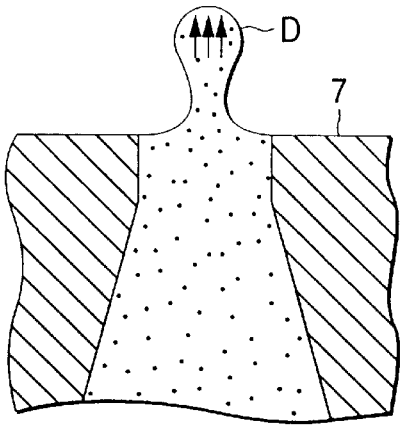
Figure 4:
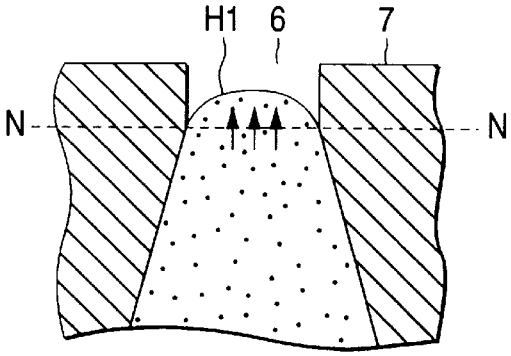
Figure 4:
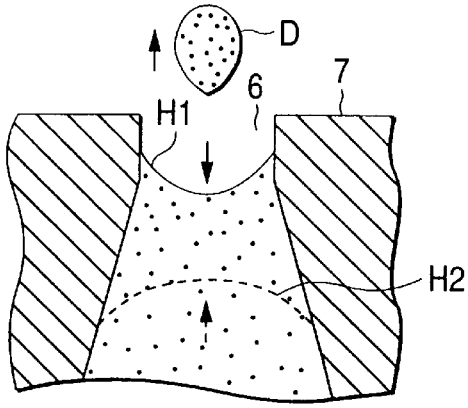

FIG. 3 shows signals for use in the driving method according to the first embodiment of the present invention, wherein when a first signal S11 is applied to the piezo-electric vibrator 11 so as to contract the piezo-electric vibrator 11, the elastic plate 8 undergoes elastic deformation in a direction in which it is separated from the pressure generating chamber 2, so that the volume of the pressure generating chamber 2 is increased. A meniscus staying static in the proximity of the nozzle opening 6 (FIG. 4(I)) is drawn by negative pressure toward the depth side of the nozzle opening 6 due to the expansion of the pressure generating chamber 2 (FIG. 4(II)) and ink in the reservoir 3 is caused to flow from the ink supply port 4 into the pressure generating chamber 2.

When a second signal S12 for maintaining high voltage at the time of charging is applied after the piezo-electric vibrator 11 is charged because of the first signal S11, the pressure of the ink stored in the pressure generating chamber 2 at the aforementioned step is rapidly released as the pressure generating chamber 2 stops expanding and maintains constant volume. Consequently, the meniscus drawn into the nozzle opening 6 starts a vibration H1 with the period Tc of the Helmholtz resonance vibration and moves toward the nozzle opening side. In other words, the Helmholtz resonance vibration with the period Tc is excited in the meniscus (FIG. 4(III)).

While the meniscus is generating the Helmholtz resonance vibration, the volume of the pressure generating chamber 2 contracts with the passage of time as the piezo-electric vibrator 11 elongates when part of the charge given by the first signal S11 is discharged by applying a third signal S13 to the piezo-electric vibrator 11. With this contraction, the meniscus on which the Helmholtz resonance vibration with the period Tc is superposed because of the third signal S13 is pushed out toward the entrance of the nozzle opening 6 along the neutral line N—N of the vibration. Then only a peak due to the Helmholtz resonance vibration with the period Tc superposed on the meniscus is protruded from the nozzle opening 6 (FIG. 4(IV)) and an ink droplet D is separated from the meniscus and caused to fly in the air (FIG. 4(V)). The quantity of the ink droplet D is smaller than that of an ink droplet resulting from jetting out ink from the nozzle opening 6 directly by pressure loading after the pressure generating chamber 2 is pressurized by the piezo-electric vibrator 11.

At the stage where a signal duration T14 has elapsed, a fifth signal S15 is applied to the piezo-electric vibrator 11 whose elongation has stopped because of a fourth signal S14 in order to discharge the residual charge of the piezo-electric vibrator 11 again, whereupon the piezo-electric vibrator 11 elongates, thus reducing the volume of the pressure generating chamber 2, so that positive pressure is generated in the pressure generating chamber 2. Consequently, the Helmholtz resonance vibration H2 with the period Tc is directed to the front end of the nozzle opening 6 (FIG. 4(VI)).

The fifth signal S15 is applied so that the piezo-electric vibrator 11 is elongated again at a point of time when the peak of the Helmholtz resonance vibration with the period Tc that has been superposed on the meniscus for the purpose of discharging the ink droplet is reversed from the nozzle opening 6 toward the pressure generating chamber side by regulating the timing of its application, that is, the duration of the fourth signal S14. Thus, a very small ink droplet such as an ink mist is prevented from being jetted since the Helmholtz resonance vibration with the period Tc that has been superposed on the meniscus is canceled by a newly-generated Helmholtz resonance vibration resulting from the re-elongation of the piezo-electric vibrator 11.

More specifically, the meniscus is drawn into the nozzle opening 6 after the ink droplet for printing is isolated and ink is caused to flow into the pressure generating chamber 2 from the ink supply port 4 due to the surface tension of the meniscus, the ringing of the period Tc of the Helmholtz resonance vibration and so on. Therefore, the meniscus with the residual Helmholtz resonance vibration with the period Tc is moved again toward the nozzle opening 6 even in such a state that the piezo-electric vibrator 11 stays static. Ultimately, the peak of the Helmholtz resonance vibration superposed as in the case where the ink droplet for printing is jetted is separated and a very small ink droplet is produced.

In the above-described embodiment of the present invention, the residual vibrating portion of the Helmholtz resonance vibration with the period Tc which is effectively acting whereby to jet an ink droplet for printing is suppressed because a Helmholtz resonance vibration is generated in opposite phase with respect to the Helmholtz resonance vibration with the period Tc superposed on the meniscus after ink is jetted by means of the fifth signal S15, so that a useless ink droplet is prevented from being produced.

Figure 5:
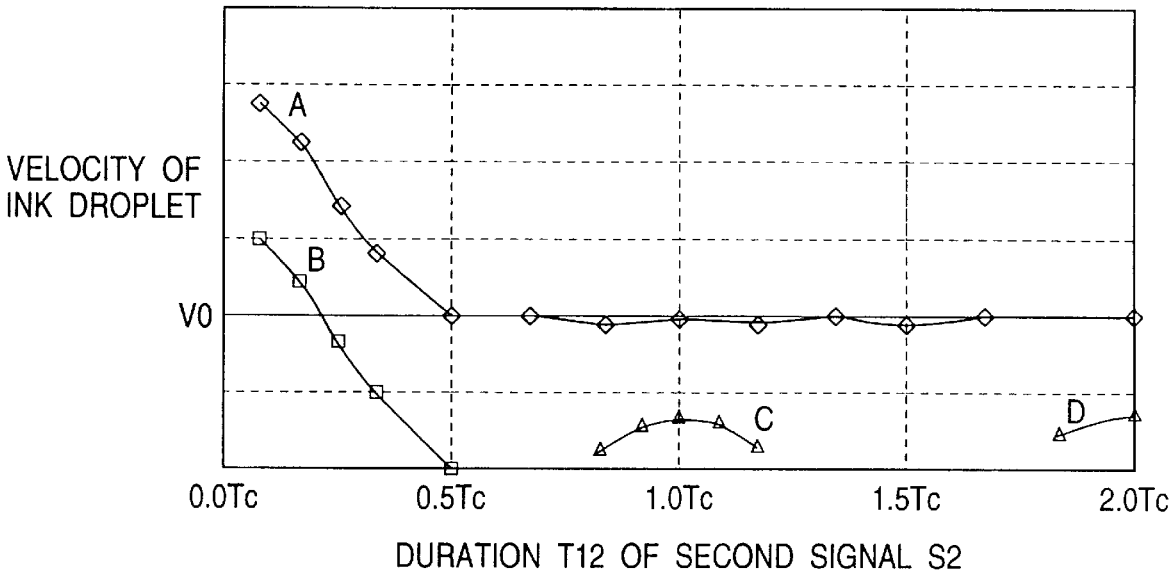
FIG. 5 is a chart showing the relation between the duration of a second signal and the flying velocity of ink droplets.

FIG. 5 shows the results obtained from investigating the relation between the duration T12 of the second signal S12 and the flying velocity of the ink droplet in cases where driving is carried out when the charge voltage of the piezo-electric vibrator 11 by means of the first signal S11 is set at the same value as before (symbol A in FIG. 5) and when the charge voltage of the piezo-electric vibrator 11 is reduced until no ink droplet is jetted (symbol B therein).

As the driving voltage is lowered, the velocity of the ink droplet also lowered. In an area where the duration T12 of the second signal S12 is ½ of the period Tc of the Helmholtz resonance vibration, however, it is possible to produce an ink droplet having a velocity of what exceeds vO which is fit for printing since the Helmholtz resonance vibration of the meniscus is pushed toward the nozzle opening side because of the third signal S13.

In other words, when the duration T12 of the second signal S12 exceeds ½ of the period Tc of the Helmholtz resonance vibration, the velocity of the ink droplet is lowered and the flying state of the ink droplet is destabilized so that printing becomes impossible.

Consequently, the flying velocity of the ink droplet can be maintained at v0 which is fit for printing while the highest charge voltage of the piezo-electric vibrator 11 is being reduced by setting the duration T12 of the second signal S12 shorter than ½ of the period Tc of the Helmholtz resonance vibration. Needless to say, driving at a low voltage is led to the lowering of the amplitude of the Helmholtz resonance vibration and it is accordingly possible to prevent the generation of a satellite originating from the residual vibration of the meniscus after an ink droplet for printing is jetted.

Figure 19:
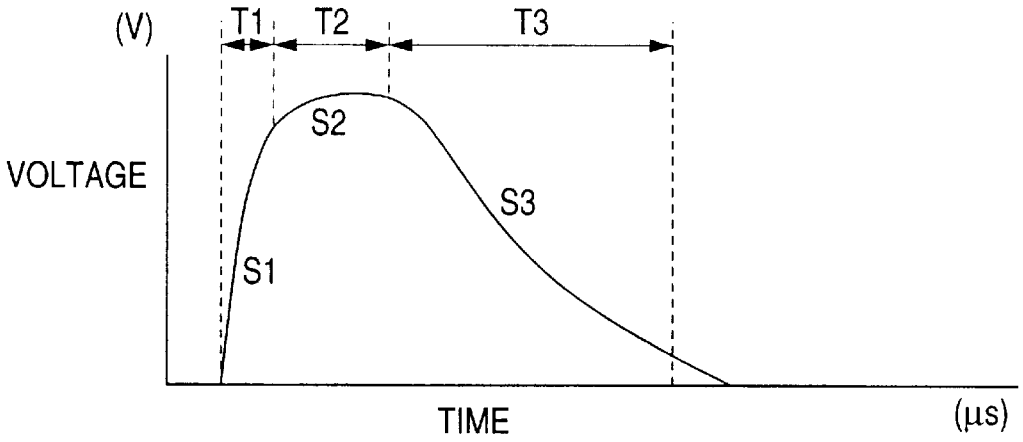
FIG. 19 is a waveform chart showing an example of a driving signal for use in the conventional driving method.
Figure 20:
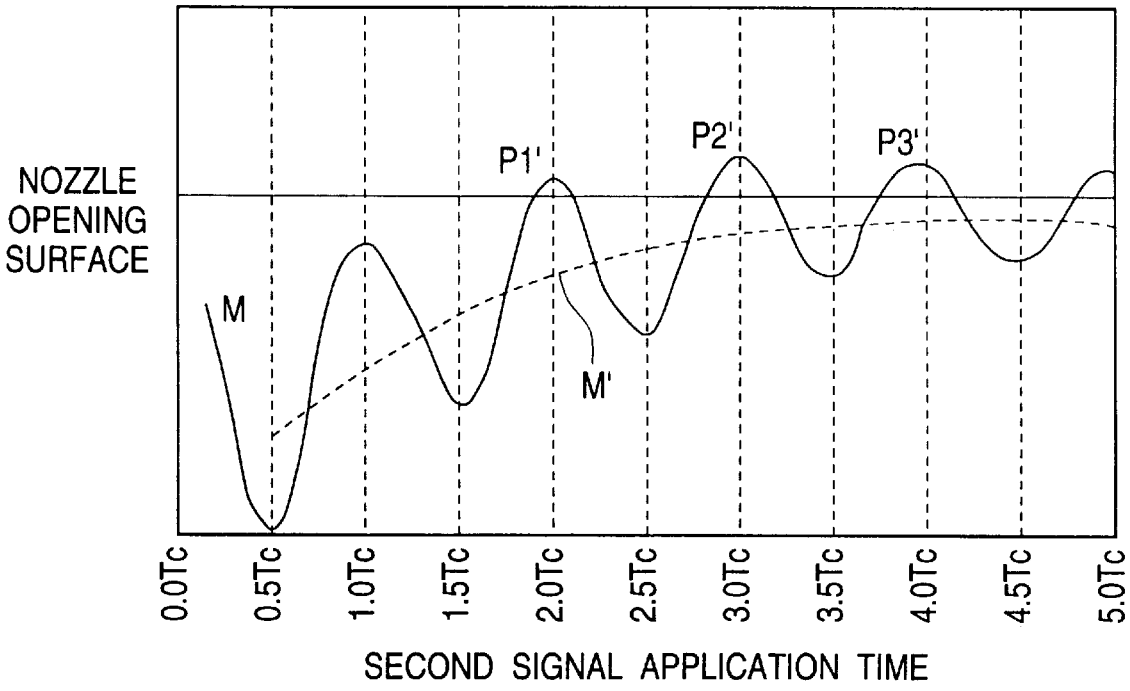
FIG. 20 is a chart showing the displacement of a meniscus.

In a conventional method, on the contrary, satellites having flying velocity with symbols C, D of FIG. 5 were produced despite the fact that a first signal S1 (FIG. 19) was set so that it corresponded to a curve A in FIG. 5; the duration T3 of a third signal S3 was set so that it substantially corresponded to the period Tc of the Helmholtz resonance vibration; and a meniscus was slowly pushed toward the nozzle opening side by means of the third signal S3.

Since driving at a low voltage results in shortening the attenuation time of the residual vibration of the meniscus as the amplitude of the Helmholtz resonance vibration is reducible, the time required until the next ink droplet becomes jettable, thus making feasible driving at a high frequency, that is, high-speed printing.

When the duration T12 of the second signal S12 is set not greater than ½ of the period Tc of the Helmholtz resonance vibration, further, the Helmholtz resonance vibration of the meniscus is pushed toward the nozzle opening side by means of the third signal S13 in order to jet an ink droplet, whereas when the duration T12 of the second signal S12 is greater than ½ of the period Tc of the Helmholtz resonance vibration, the Helmholtz resonance vibration of the meniscus is conversely set in opposite phase and it ceases to function as what pushes the meniscus for the purpose of discharging an ink droplet. In consequence, it is preferred to set the duration of the second signal S12 not greater than ½ of the period Tc of the Helmholtz resonance vibration.

If the duration T12 of the second signal S12 is set to ½ or less of the period Tc of the Helmholtz resonance vibration, the quantity of an ink droplet to be jetted will vary as the meniscus is pushed by the third signal S13.

Figure 6:
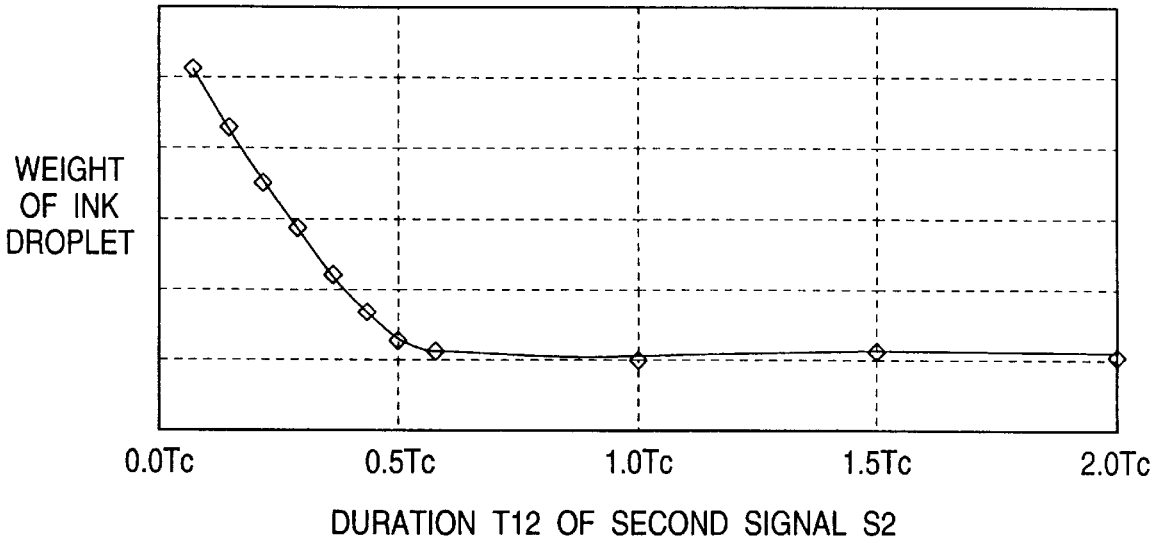
FIG. 6 is a chart showing the relation between the duration of the second signal and the weight of the ink droplet.

FIG. 6 shows the relation between the duration T12 of the second signal S12 and the weight of ink in the form of an ink droplet to be jetted, wherein if the duration T12 of the second signal S12 is varied within the range of ½ or less of the period Tc of the Helmholtz resonance vibration, the weight of an ink droplet to be jetted will be seen to be proved easily adjustable.

It is therefore a method useful for attaining high gradation by changing the size of the dot formed on a recording medium or the like and materializing a recording apparatus capable of printing an image of substantially the same degree of print quality that is obtainable from photographs to set the duration T12 of the second signal S12 to ½ or less of the period Tc of the Helmholtz resonance vibration.

Figure 7:
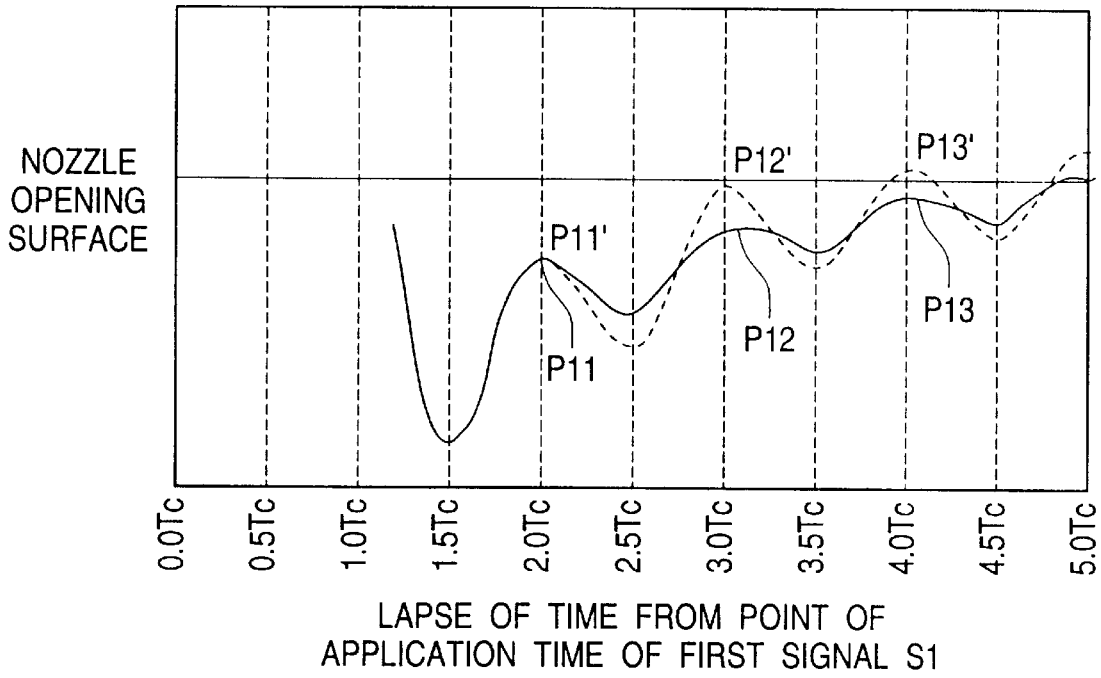
FIG. 7 is a chart showing variations in the positions of the meniscuses with the passage of time after ink droplets are jetted by means of the driving method according to the first embodiment of the present invention and a conventional driving method.

Referring to FIG. 7, there will subsequently be given a description of the timing of applying the fifth signal S15 in order to control the residual vibration with the period Tc of the Helmholtz resonance vibration. FIG. 7 refers to cases where a solid curved line represents the displacement of the meniscus after the ink droplet is jetted with the period Tc of the Helmholtz resonance vibration as a time unit under the driving method according to the present invention and where a dotted line represents a state in which the meniscus is left as it is after the ink droplet is jetted by means of the third signal S13. In FIG. 7, symbols P11, P12, P13, . . . and P11', P12', P13', . . . represent positions of peaks at which the Helmholtz resonance vibration with the period Tc is directed from the pressure generating chamber 2 toward the nozzle opening 6.

In the above-described embodiment of the present invention, the fifth signal S15 which continues for a shorter time than the period Tc of the Helmholtz resonance vibration in agreement with points of time when P11', P12', P13', . . . are produced is applied by adjusting the time width T14 of the fourth signal S14 in such a manner conforming to a point of time Tc×2 from a point of time the application of the first signal S11 is started, that is, a point of time the peak P11 is produced. Consequently, the pressure generating chamber 2 contracts and the Helmholtz resonance vibration is generated in a direction in which the meniscus is pushed back from the pressure generating chamber 2 to the nozzle opening 6. Then the Helmholtz resonance vibrations cancel each other and the peaks P11, P12, P13, . . . of the amplitude are positioned closer to the pressure generating chamber than the peaks P11', P12', p13', . . . at the same point of time in the conventional driving method.

The operation described above is made performable as follows:

The piezo-electric vibrator 11 is caused to rapidly contract by setting the duration T11 of the first signal S11 shorter than the period Tc of the Helmholtz resonance vibration, preferably setting the former to ½ or less of the period Tc of the Helmholtz resonance vibration and more preferably setting the former shorter than the natural vibration period of the piezo-electric vibrator 11 so as to cause the pressure generating chamber 2 to rapidly expand, whereby the Helmholtz resonance vibration with the period Tc is superposed on the meniscus by rapidly drawing the meniscus into the pressure generating chamber 2 from the nozzle opening 6.

The pressure generating chamber 2 is caused to contract by applying the third signal S13 and the ink droplet is jetted with the assistance of the Helmholtz resonance vibration with the period Tc of the meniscus. If the second signal S12 is set to ½ or less of the period Tc of the Helmholtz resonance vibration then, a very small ink droplet having velocity fit for printing can be produced by reducing the quantity of expansion of the pressure generating chamber 2 by means of the first signal S11 without lowering the flying velocity of the ink droplet to a velocity of v0 fit for printing or lower.

Since the weight of ink in the form of an ink droplet to be jet is made adjustable by changing the second signal S12 within the range of ½ or less of the period Tc of the Helmholtz resonance vibration, an image excellent in gradation is formable.

In order to prevent the Helmholtz resonance vibration excited by the first signal S11 from being uselessly amplified, the duration T13 of the third signal S13 is set to the period Tc of the Helmholtz resonance vibration or greater and preferably at substantially the same value as the period Tc of the Helmholtz resonance vibration.

Although the time elapsed from the start of the first signal S11 is integer times the period Tc of the Helmholtz resonance vibration, the fifth signal S15 is preferably applied when the time twice as long as the period Tc of the Helmholtz resonance vibration elapses from the start of the application of the first signal S11 in order to control the residual vibration after an ink droplet is jetted by means of the Helmholtz resonance vibration as quick as possible without affecting the ink droplet jetted. Since the fifth signal S15 results from generating the Helmholtz resonance vibration in opposite phase to the Helmholtz resonance vibration with the period Tc induced by the meniscus, its duration T15 is shorter than the period Tc of the Helmholtz resonance vibration and more specifically, it preferably conforms to the duration T11 of the first signal S1, whereby the vibration controlling action can be enhanced to a greater extent by inducing substantially the same Helmholtz resonance vibration as the period Tc of the Helmholtz resonance vibration by means of the first signal S11.

Further, the fifth signal S15 is such that its voltage variation is able to suppress the residual vibration of the Helmholtz resonance vibration; it is large enough to prevent the ink droplet from being uselessly jetted even by the application of the fifth signal S15; and the quantity of elongation of the piezo-electric vibrator 11 by means of the third signal S13 is within a range of securing such a voltage variation as to cause an ink droplet fit for printing to be jetted. More specifically, the voltage variation of the fifth signal S15 is preferably set 0.2 to 0.8 time the variation of the first signal S11.

In other words, the residual vibration of the Helmholtz resonance vibration after the ink droplet is jetted cannot be suppressed satisfactorily in a case where the driving voltage of the fifth signal S15 is set lower than 0.2 time the driving voltage of the first signal S11, and the ink droplet is not jettable because the meniscus is not effectively pushed as the voltage variation of the third signal S13 becomes less in a case where the driving voltage of the former is set higher than 0.8 time the driving voltage of the latter.

In summarizing representative data on the driving signals for materializing the aforementioned driving method, the duration T11, T12 and T15 of the first, second and fifth signals S11, S12 and S15 each range from 0% to 50% of the period Tc of the Helmholtz resonance vibration. Further, the duration T13 of the third signal S13 is greater than the period Tc of the Helmholtz resonance vibration and preferably and substantially conforms to the period Tc of the Helmholtz resonance vibration; the duration T14 of the fourth signal S14 corresponds to a value for making the duration from the start of application of the first signal S11 up to the start of application of the fifth signal S15 becomes integer times the period Tc of the Helmholtz resonance vibration, preferably twice as long as the period Tc of the Helmholtz resonance vibration; and the voltage variation of the fifth signal S15 ranges from 20% to 80% of the voltage variation of the first signal S11.

Figure 8:
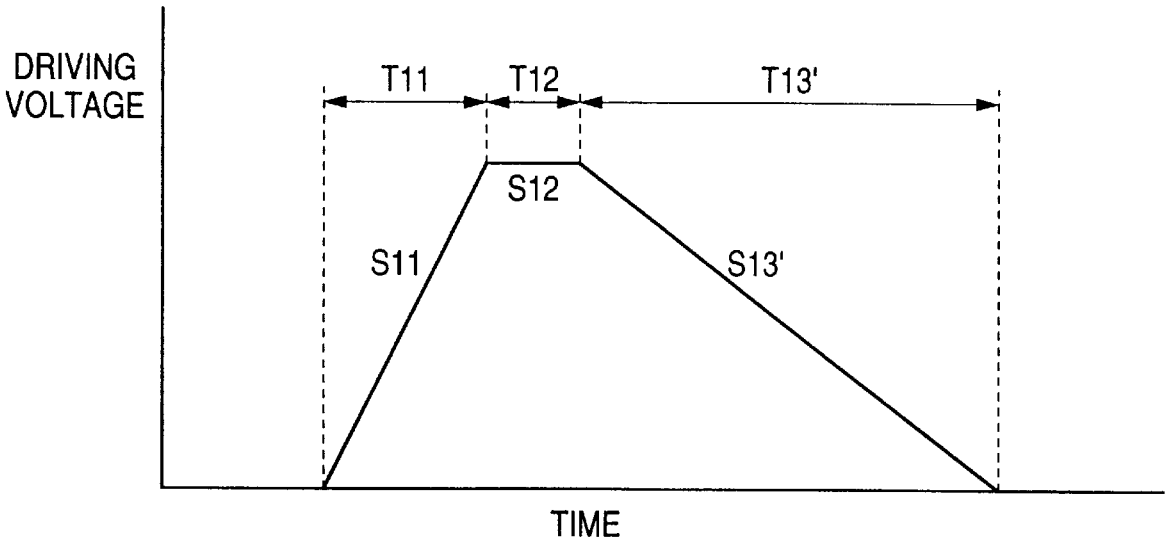
FIG. 8 is another signal waveform chart using the principle according to the first embodiment of the present invention.

In the above-described embodiment of the present invention, the expansion of the pressure generating chamber 2 is maximized, that is, the piezo-electric vibrator 11 charged with the maximum voltage is discharged twice by applying the two signals S13, S15 with the fourth signal S14 held therebetween and used for holding the piezo-electric vibrator 11 in a constant condition intermediately in order to cancel the residual vibration of the meniscus by the Helmholtz resonance vibration by means of the fifth signal. However, since the generation of an uninvited ink droplet such as an ink mist is preventable after an ink droplet fit for printing is jetted as described above on condition that the second signal S12 is set shorter than the period Tc of the Helmholtz resonance vibration, preferably time gradient is used to the extent that the meniscus is not uselessly forced out as shown in FIG. 8, that is, a third signal S13' dropping substantially linearly and continuously for a signal duration T13' may obviously be used to continuously discharge the charge of the piezo-electric vibrator 11 so as to achieve the same effect as described above.

Figure 9:
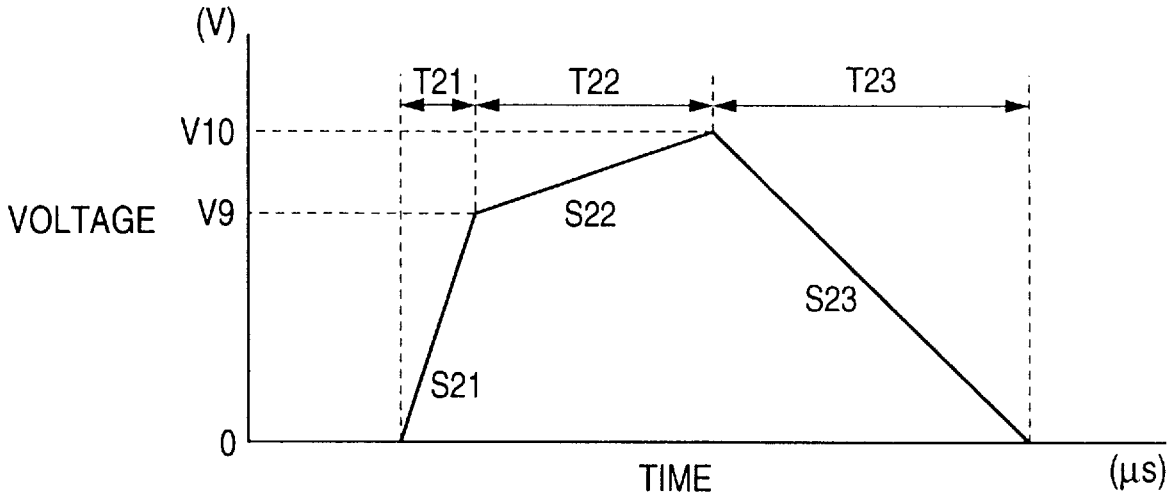
FIG. 9 is a signal waveform chart showing a method of driving an ink-jet recording head as a second embodiment of the present invention.
Figure 10:
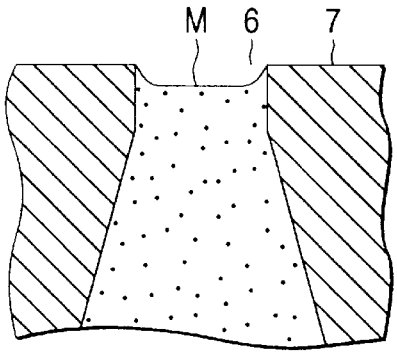
FIGS. 10(I)–(VI) show the behavior of meniscuses by means of the driving method according to the second embodiment of the present invention, respectively.
Figure 10:
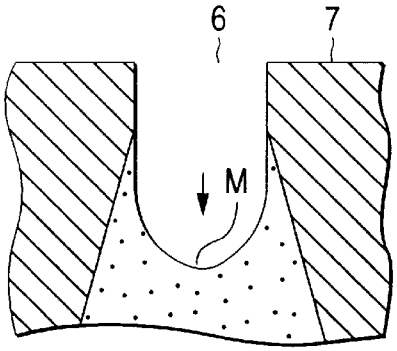
Figure 10:
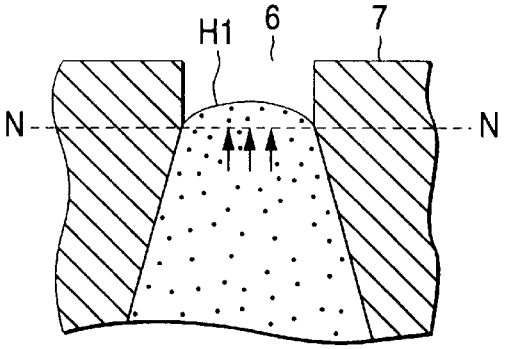
Figure 10:
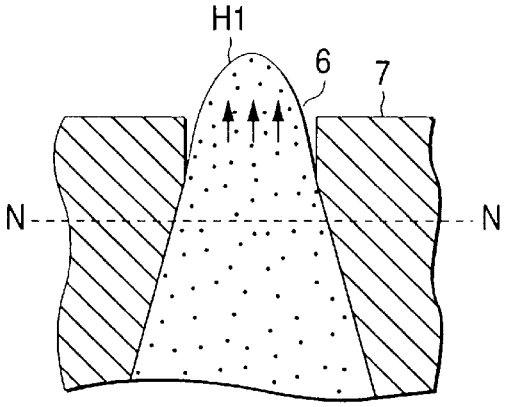
Figure 10:
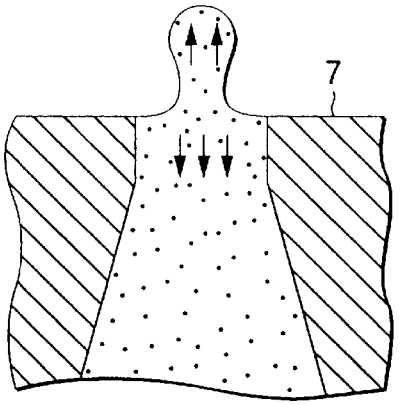
Figure 10:
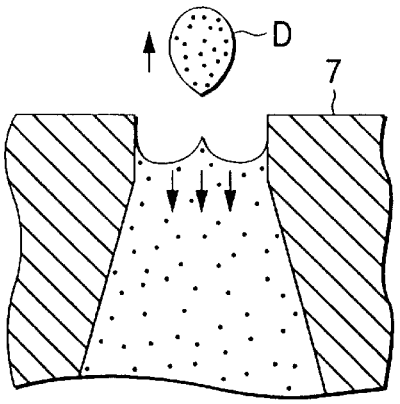

FIG. 9 shows a second embodiment of the present invention, wherein when a first signal S21 which linearly varies from voltage V0 up to voltage V9 for a signal duration T21 is applied to the piezo-electric vibrator 11 to make the piezo-electric vibrator 11 rapidly contract in such a state that a meniscus M substantially stays static in the proximity of the front end of the nozzle opening 6 (FIG. 10(I)), the volume of the pressure generating chamber 2 rapidly expands and the meniscus M staying static in the proximity of the nozzle opening is drawn into the nozzle opening 6 (FIG. 10(II)), whereby the Helmholtz resonance vibration Hi with the period Tc is induced in the meniscus (FIG. 10(III)).

Upon the termination of application of the first signal S21, a second signal S22 which slowly varies from voltage V9 up to voltage V10 for a signal duration T22 is applied, thereupon the contraction of the piezo-electric vibrator 11 is switched from rapid displacement velocity to slow displacement velocity, so that the pressure generating chamber 2 slowly expands.

On the other hand, the Helmholtz resonance vibration with the period Tc superposed on the meniscus is moved in the direction of the nozzle opening 6 due to the natural vibration of the meniscus itself with a long vibration period Tm without being affected by the slow expansion of the pressure generating chamber 2. However, the neutral line N—N of the vibration is moved to the pressure generating chamber side because of the slow expansion of the pressure generating chamber 2 (FIG. 10(IV)). In the course of the slow expansion of the pressure generating chamber 2, part of the front end region of the meniscus is protruded because of the Helmholtz resonance vibration superposed on the meniscus, isolated as a small quantity of ink in the form of an ink droplet fit for printing (FIG. 10(V)) and caused to fly onto a recording medium (not shown).

More specifically, while the meniscus is moving to the front end of the nozzle opening 6, the second signal S22 is applied to the pressure generating chamber 2 so as to slowly contract the piezo-electric vibrator 11, thereupon the Helmholtz resonance vibration with the period Tc itself superposed on the meniscus is set free from being affected by negative pressure resulting from the expansion of the pressure generating chamber 2, whereby only the neutral line N of the meniscus is displaced from the nozzle opening 6 toward the pressure generating chamber side. Therefore, the peak of the meniscus swelling up from the front end of the nozzle opening 6 can be made smaller. Consequently, the quantity of ink in the form of an ink droplet relevant to the protruded quantity of the meniscus is reduced, so that a high-density ink droplet fit for graphic printing can be jetted.

Since the volume of the pressure generating chamber 2 is slowly enlarged by applying the second signal S22 for varying the voltage from V9 up to V10, moreover, an ink droplet fit for printing is isolated and the ink droplet is shaped into a sphere as the slow rear end portion of the meniscus existing closer to the nozzle opening side than the jetted area is brought back to the nozzle opening side, and the generation of a satellite is also prevented (FIG. 10(VI)).

Figure 11:
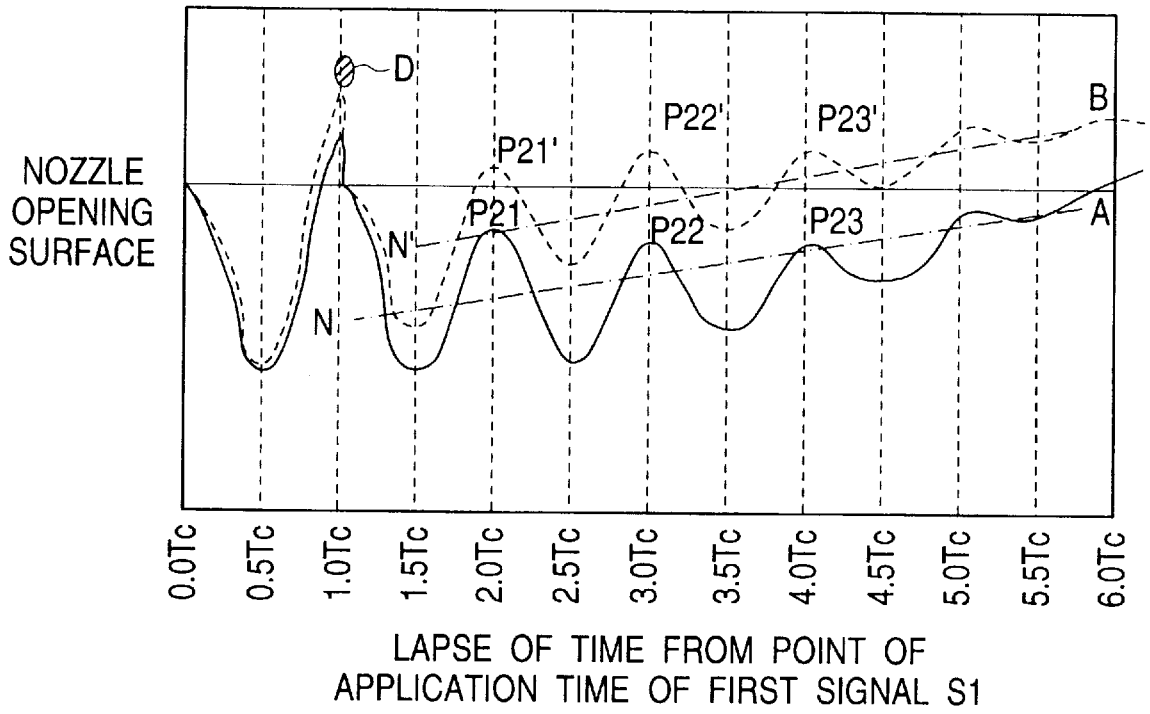
FIG. 11 is a chart showing variations in the positions of the meniscuses with the passage of time after ink droplets are jetted by means of the driving method according to the second embodiment of the present invention and a conventional driving method.

In other words, since the meniscus forms an ink droplet D and then continues to generate the Helmholtz resonance vibration with the period Tc as shown in FIG. 11, there develop peaks P21', P22', P23', . . . (a curve shown by a symbol B in FIG. 11) protruding toward the nozzle opening side due to the displacement of the meniscus during time length integer times the period Tc of the Helmholtz resonance vibration from a point of time the application of the first signal S21 is started and these peaks P21', P22', P23', . . . are jetted as satellites.

However, the second signal S22 is used to keep up expanding the volume of the pressure generating chamber 2 even after the Helmholtz resonance vibration is generated by means of the first signal S21 according to this embodiment of the present invention and consequently the peaks P21, P22, P23, . . . (a curve shown by a symbol A in FIG. 11) at the point of time integer times the period Tc of the Helmholtz resonance vibration after the application of the first signal S21 is started are controlled by the neutral line N pulled into the pressure generating chamber rather than the neutral line N' of the meniscus in the conventional driving method without accompanying the expansion of the pressure generating chamber 2, and prevented from protruding from the nozzle opening 6 to ensure that the generation of an unnecessary ink droplet such as a satellite is prevented.

Upon the termination of the second signal S22, a third signal S23 which substantially linearly varies from voltage V10 up to voltage V0 with time width T23 is applied to the piezo-electric vibrator 11, thereupon the piezo-electric vibrator 11 is slowly elongated so as to slowly reduce the volume of the pressure generating chamber 2. Then the meniscus moves its position in a direction in which the nozzle opening 6 is filled up while accompanying the attenuating vibration with the period Tc and returns to a position fit for discharging an ink droplet next time. Incidentally, no ink mist is allowed to splash because the Helmholtz resonance vibration with the period Tc superposed on the meniscus has been attenuated sufficiently at this point of time.

In order to make a very small quantity of ink in the form of an ink droplet fit for printing jettable when time equivalent to the period Tc of the Helmholtz resonance vibration elapses from the point of time the application of the first signal S21 is started, it is needed to generate the Helmholtz resonance vibration to a greater extent and consequently the duration T21 of the first signal S21 is shorter than the period Tc of the Helmholtz resonance vibration, preferably ½ or less of the period Tc and more preferably not greater than the natural vibration period of the piezo-electric vibrator 11.

After the meniscus is used to form an ink droplet, the displacement of the meniscus is preferably positioned within the nozzle opening 6 without fail in view of preventing an ink mist from being generated. Therefore, the sum of the duration of first and second signals S21 and S22, that is, T21+T22 is preferably set so that it is not less than the period Tc of the Helmholtz resonance vibration.

In order to prevent a new Helmholtz resonance vibration from being induced by the application of the second signal S22, further, the duration T22 of the second signal S22 is preferably set not less than the period Tc of the Helmholtz resonance vibration. Particularly when the duration T22 of the second signal S22 is set riot less than twice as long as the period Tc of the Helmholtz resonance vibration, the peak P21 which is most likely to generate an ink mist when time twice as long as the period Tc of the Helmholtz resonance vibration elapses after the application of the first signal S21 is started can be made to stay within the nozzle opening 6.

When the duration T23 of the third signal S23 is set not less than the length of the period Tc of the Helmholtz resonance vibration, preferably set at the same value as that of the period Tc of the Helmholtz resonance vibration, the meniscus can be returned to the front end of the nozzle opening 6 quickly without inducing the Helmholtz resonance vibration therein.

In the ink-jet recording head according to this embodiment of the present invention, the inertance MS of the ink supply port is set at the same value as the inertance Mn ($1\times10^8$(Kg/m$^4$)) of the nozzle opening 6 so that the meniscus may be returned to a position fit for discharging an ink droplet next time quickly after an ink droplet is jetted along the vibration with the period Tm.

In the course of returning the meniscus to the initial position, further, the process of expanding the pressure generating chamber 2 is maintained by the second signal S22, whereby the peaks P21'–P23' generated until the passage of time four times the period Tc of the Helmholtz resonance vibration after the application of the first signal S21 is started can be made to stay within the nozzle opening 6 like the peaks P21, P22, P23. Thus, the generation of an excessive ink droplet such as a satellite is preventable.

In addition, the peaks P21', P22' cause part of the meniscus to protrude from the nozzle opening 6 when the ink-jet recording head with the ink supply port so designed as to make the meniscus return to the initial position quickly in preparation of discharging an ink droplet next time after an ink droplet is jetted is employed in the conventional driving method, thus allowing an ink mist to splash. When it is attempted to design an increase in the flow channel resistance of the ink supply port to prevent such an ink mist from splashing, the return motion of the meniscus toward the initial position is slowed and this also raises a new problem in that the driving frequency response capability of the head is lowered.

Since the process of expanding the pressure generating chamber 2 by means of the second signal S22 can be maintained at the step of discharging an ink droplet according to this embodiment of the present invention, a useless ink droplet is preventable from being jetted after an ink droplet is jetted even in the case of an ink-jet recording head having an ink supply port which is formed in such a manner that accelerates the resetting velocity of a meniscus, so that an ink-jet recording head capable of offering not only high print quality but also high driving frequency response capability can be materialized thereby.

Figure 12:
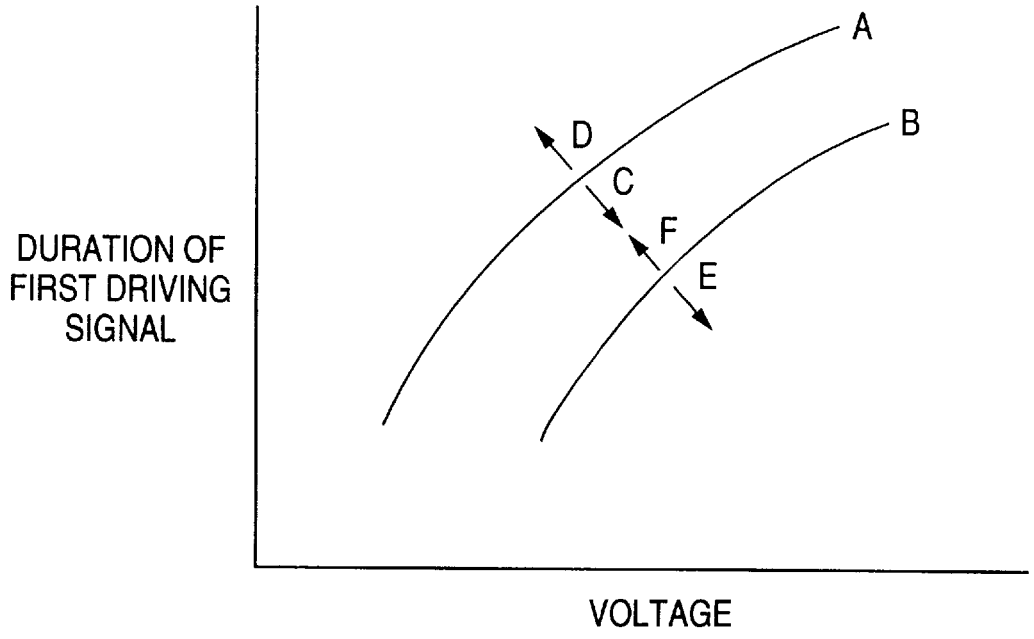
FIG. 12 is a chart showing the relation between the voltage and the duration of the first signal with reference to variations in ink-droplet jet characteristics by means of the driving method according to the second embodiment of the present invention.

FIG. 12 is a chart showing the ink jet characteristics of the above-described ink-jet recording head, wherein there are shown therein a right-hand area (an arrow C) which is lower than a marginal curve A where an ink droplet is spontaneously jetted when the first signal S21 is applied to the piezo-electric vibrator 11, and a left-hand boundary area (an arrow D) above the marginal curve A where no ink droplet is spontaneously jetted even when the first signal S21 is applied to the first signal S21.

In the case of the conventional driving method, that is, a driving method for discharging a ink droplet in which the pressure generating chamber is not expanded during the process of moving a meniscus when a very small ink droplet is jetted by moving the meniscus toward a nozzle opening, a marginal curve B represents the margin of ink-mist generation. In a right-hand area (an arrow E) which is lower than the marginal curve B, an ink mist is generated because of the aforementioned peak P21', P22' and in a left-hand area (an arrow F) above the marginal curve B, the flying velocity of the ink droplet produced for the purpose of printing is 5 m/S or lower, though no ink mist is produced.

Since the negative pressure is caused to act in the direction in which the meniscus is pulled into the nozzle opening 6 after an ink droplet fit for printing is jetted by applying the second signal S22 according to this embodiment of the present invention, no generation of an ink mist is seen in the area indicated by the arrow E below the marginal curve B.

Therefore, an ink droplet can be jetted with a small quantity of ink, namely, an ink quantity of 2 ng and an ink droplet flying at high velocity, namely, at a velocity of 10 m/S according to experimental data.

Figure 13:
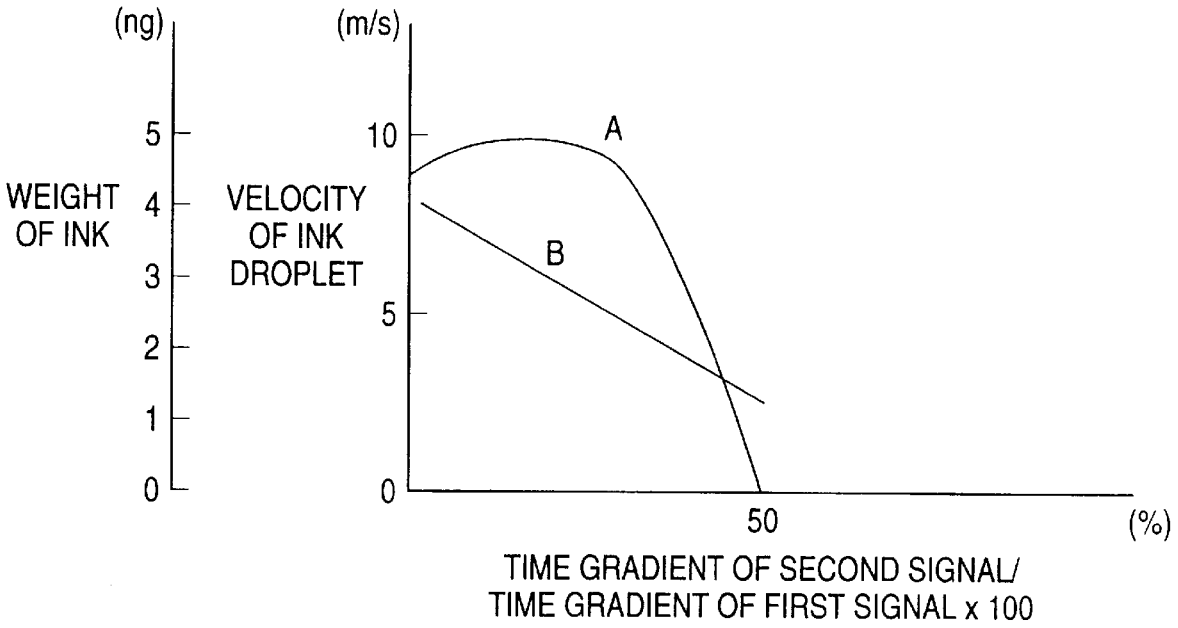
FIG. 13 is a chart showing the relation among the ratio of the time gradient of the first signal to the time gradient of the second signal, the velocity of ink droplets and the weight of ink.

FIG. 13 is a chart showing the relation among the ratio of the time gradient of the first signal S21 to the time gradient of the second signal S22, the velocity of ink droplets (a curve A in FIG. 13) and the weight of ink (a curve B therein). As is obvious from FIG. 13, the time gradient of the second signal S22 is required to be at most 50% or lower of the time gradient of the first signal S21 because no ink droplet is jetted when the above ratio exceeds 50%. Moreover, the quantity of ink in the form of an ink droplet can be changed without causing the flying velocity of the ink droplet to be varied when only the time gradient of the second signal S22 is varied with the time gradient of the first signal S21 kept constant; thus an image excellent in gradation is formable.

Figure 14:
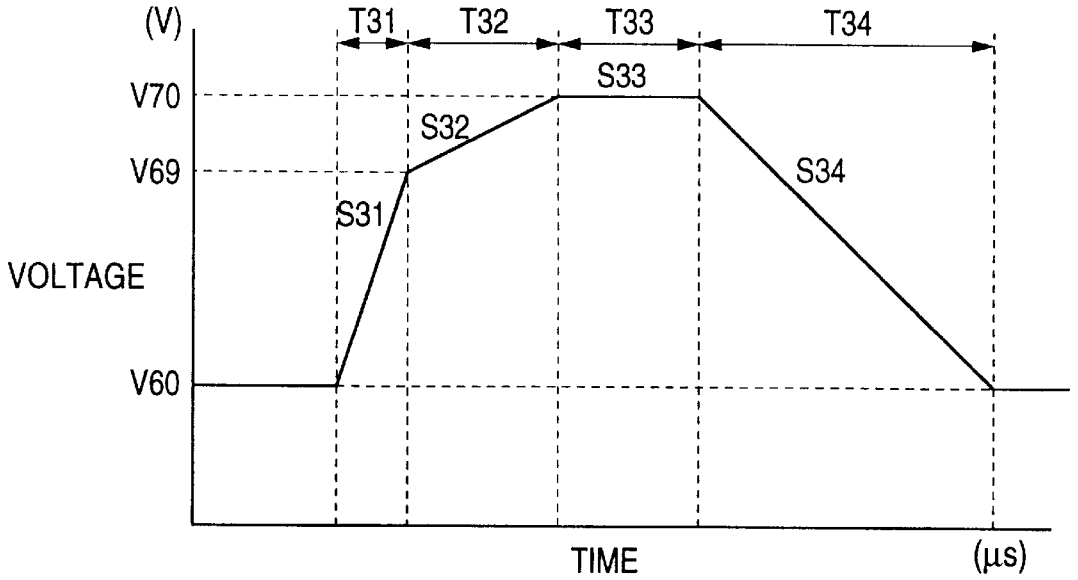
FIG. 14 is a signal waveform chart showing a method of driving an ink-jet recording head as a third embodiment of the present invention.

FIG. 14 shows a third embodiment of the present invention, wherein a specific voltage of V60 has been applied to the piezo-electric vibrator 11 in a standby state according to this embodiment thereof and there is provided the step of holding the volume of the pressure generating chamber constant between the step of finely expanding the pressure generating chamber and the step of resetting the meniscus.

In such a state that the pressure generating chamber 2 is kept in the expanded condition to a predetermined degree because of the piezo-electric vibrator 11 that has been charged with the voltage V60, a first signal S31 which substantially linearly varies from voltage V60 up to voltage V69 for a signal duration T31 is applied, whereupon the piezo-electric vibrator 11 rapidly contracts, whereas the volume of the pressure generating chamber 2 rapidly expands. Then the meniscus is pulled into the nozzle opening 6 and starts vibration with the period .c of the Helmholtz resonance vibration as described above.

Upon the termination of the first signal S31, a second signal S32 which slowly varies from voltage V69 up to voltage V70 for a signal duration T32 is applied, thereupon the contraction of the piezo-electric vibrator 11 is switched from rapid displacement velocity to slow displacement velocity, so that a change in the volume of the pressure generating chamber 2 is switched to slow expansion.

On the other hand, the Helmholtz resonance vibration with the period Tc superposed on the meniscus is moved in the direction of the nozzle opening 6 due to the natural vibration of the meniscus itself with a long period without being affected by the slow expansion of the pressure generating chamber 2. In the course of its slow movement toward the nozzle opening 6, the front end region of the Helmholtz resonance vibration with the period Tc superposed on the meniscus is isolated as a small quantity of ink in the form of an ink droplet fit for printing and caused to fly onto a recording medium.

More specifically, while the meniscus is moving to the front end of the nozzle opening 6, the second signal S32 is applied to the pressure generating chamber 2 so as to slowly contract the piezo-electric vibrator 11, thereupon the Helmholtz resonance vibration with the period Tc itself superposed on the meniscus is set free from being affected by negative pressure resulting from the expansion of the pressure generating chamber 2, whereby only the neutral line N of the meniscus is displaced from the nozzle opening 6 toward the pressure generating chamber side. Therefore, the quantity of ink in the form of an ink droplet relevant to the swollen quantity of the meniscus is reduced as the meniscus is positioned deeper than the front end of the nozzle opening 6 in comparison with the conventional driving method, so that a high-density ink droplet fit for graphic printing can be jetted.

Figure 15:
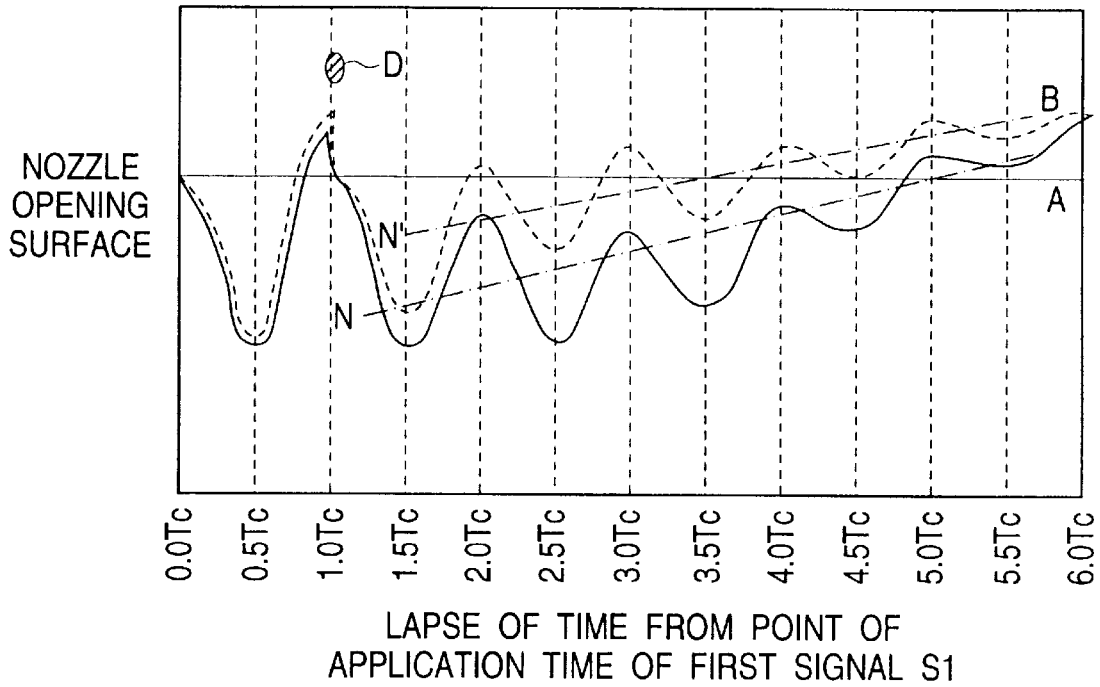
FIG. 15 is a chart showing variations in the positions of meniscuses with the passage of time after ink droplets are jetted by means of the driving method according to the third embodiment of the present invention and a conventional driving method.

Upon the termination of the second signal S32, a third signal S33 for maintaining a final charge voltage V70 is applied for a signal duration T33, whereupon the piezo-electric vibrator 11 is maintained in such a state that it is kept contracted, that is, the pressure generating chamber 2 has completely been expanded, whereby as shown in FIG. 15, the neutral line N of the vibration of the meniscus undergoing the Helmholtz resonance vibration with the period Tc is never pushed out like the neutral line N' of the meniscus in the conventional driving method.

Upon the termination of the duration of the third signal S33, a fourth signal S34 which substantially linearly varies from voltage V70 up to voltage V60 with time width T34 is applied to the piezo-electric vibrator 11, thereupon the piezo-electric vibrator 11 is slowly elongated so as to slowly reduce the volume of the pressure generating chamber 2. At this point of time, no ink mist is produced because the vibration of the meniscus has been attenuated sufficiently by the third signal S33.

Figure 16:
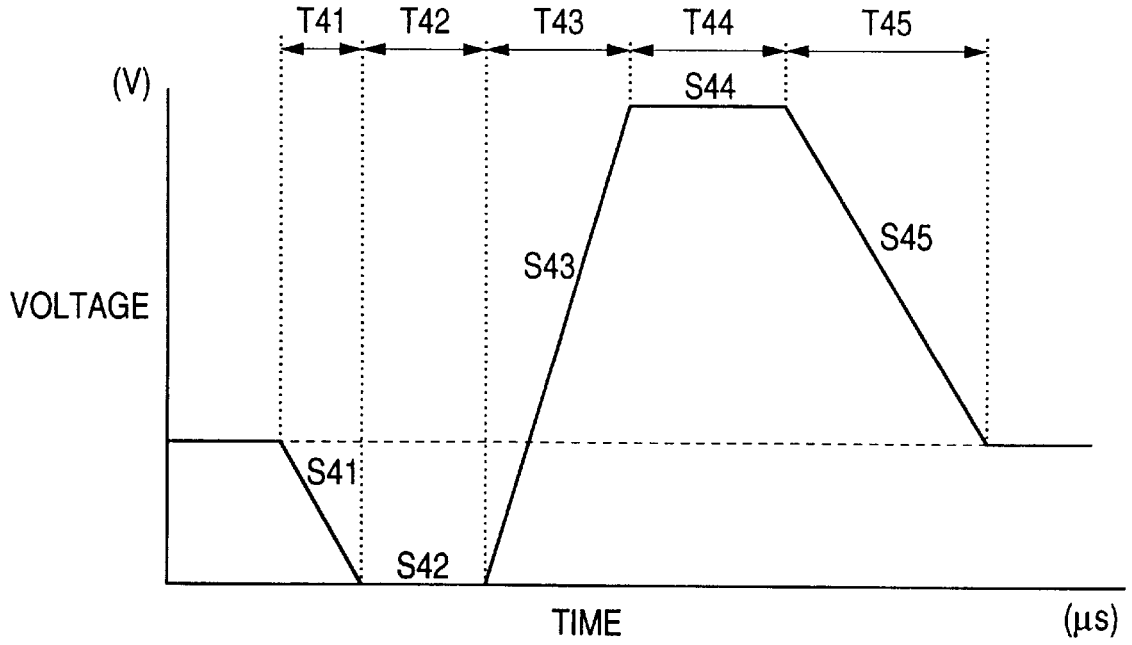
FIG. 16 is a signal waveform chart showing a method of driving an ink-jet recording head as a fourth embodiment of the present invention.

Referring to FIG. 16, there will subsequently be given a description of a fourth embodiment of the present invention.

In this embodiment of the present invention, the piezo-electric vibrator has been slightly contracted, that is, the pressure generating chamber 2 has been slightly expanded beforehand in a standstill condition.

Figure 17:
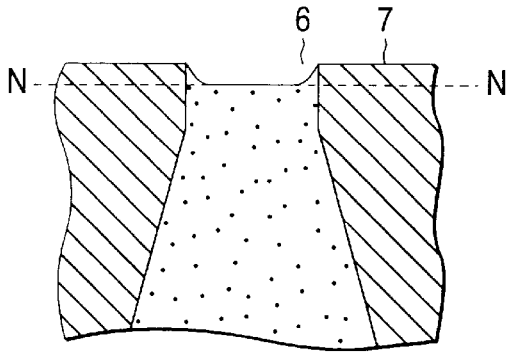
FIGS. 17(I)–(VI) show the behavior of meniscuses by means of the driving method according to the fourth embodiment of the present invention, respectively.
Figure 17:
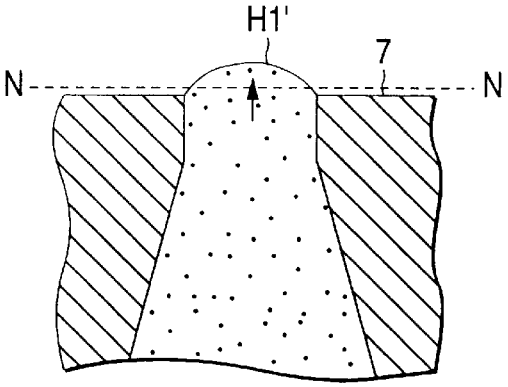
Figure 17:
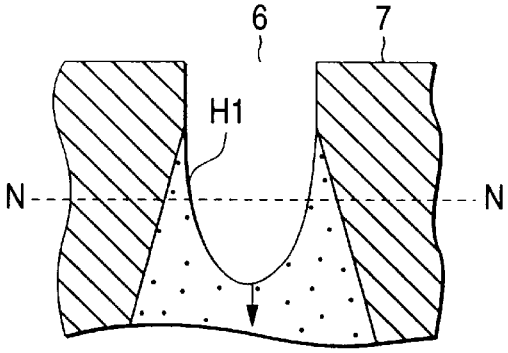
Figure 17:
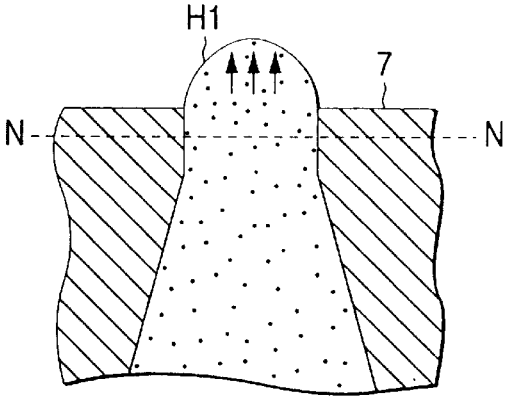
Figure 17:
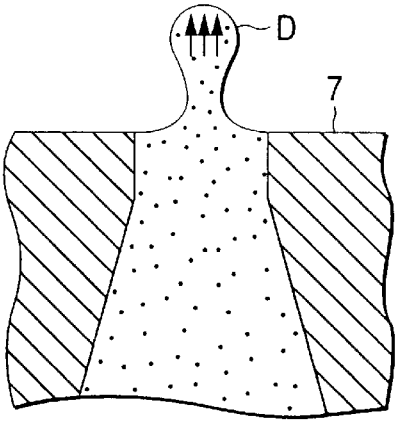
Figure 17:
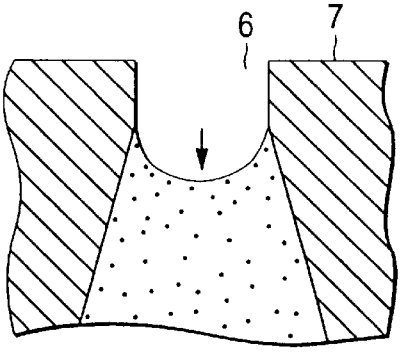

While the meniscus stays standstill in the proximity of the nozzle opening 6 (FIG. 17(I)), the piezo-electric vibrator 11 that is kept contracted is elongated when a first signal S41 is applied and discharged, and the volume of the pressure generating chamber 2 is substantially contracted so as to pressurize the pressure generating chamber 2, whereby the meniscus is swollen to the extent that it is not jetted from the nozzle opening 6 (FIG. 17(II)). If the voltage variation of the first signal S41 is great, the meniscus will needless to say be greatly pushed out then, thus causing an ink droplet to be generated. Therefore, the voltage of the first signal S41 is set so that no ink droplet is jetted.

The Helmholtz resonance vibration H1' with the period Tc is induced in the meniscus slightly pushed out of the face of the nozzle opening by the first signal S41, and the Helmholtz resonance vibration with the period Tc is continuously maintained without being greatly attenuated during the application of a second signal S42.

When the piezo-electric vibrator 11 is contracted by applying a third signal S43 thereto in this state, the volume of the pressure generating chamber 2 is expanded and the negative pressure is generated in the pressure generating chamber 2. The Helmholtz resonance vibration Hi having a great amplitude with the period Tc is induced in the meniscus, which is greatly pulled into the nozzle opening 6 (FIG. 17(III)).

When the third signal S43 is applied at a point of time the Helmholtz resonance vibration with the period Tc superposed on the meniscus is directed from the nozzle opening 6 to the pressure generating chamber 2, that is, by selecting a point of time when the length of time from the start of application of the first signal S41 until the termination of application of the second signal S42 becomes equal to ½ of the period Tc of the Helmholtz resonance vibration, the vibration energy induced by the first signal S41 is made utilizable and even though the third signal S43 is set with a relatively small voltage difference, the meniscus can be pulled into the nozzle opening 6 to a greater extent.

Then a fifth signal S45 is applied at a point of time the Helmholtz resonance vibration with the period Tc produced in the meniscus by the first signal S41 and the third signal S43 is directed to the exit of the nozzle opening 6. Like the first signal S41, the fifth signal S45 functions as what pushes the meniscus out of the nozzle opening 6 and pushes up the neutral line N of the vibration toward the nozzle opening 6. In order to prevent the Helmholtz resonance vibration with the period Tc induced in the meniscus from being uselessly amplified at this time, the duration T45 of the fifth signal S45 is set at a value exceeding the period Tc of the Helmholtz resonance vibration, preferably at substantially the same value as Tc.

When the neutral line of the meniscus vibration is pushed up by applying the fifth signal S45, the Helmholtz resonance vibration superposed on the meniscus is protruded from the nozzle opening 6 (FIG. 17(IV)). A portion equivalent to the peak of the meniscus thus swollen out of the nozzle opening 6 is isolated and becomes an ink droplet D before being jetted (FIG. 17(V)) because the displacement velocity of the meniscus in this state is greater than the displacement velocity of the meniscus by the first signal S41 to the extent that the Helmholtz resonance vibration has been superposed thereon.

Although the meniscus after the ink droplet is jetted is pulled into the depth of the nozzle opening 6 (FIG. 17(VI)), the Helmholtz resonance vibration on the meniscus is small and no satellite is produced because the potential difference of the third signal S43 is set relatively small.

It is thus preferred to apply the fifth signal S45 at the point of time the Helmholtz resonance vibration with the period Tc superposed on the meniscus is directed to the exit of the nozzle opening 6 in order that a very small ink droplet fit for printing is jetted by isolating part of the meniscus.

Figure 18:
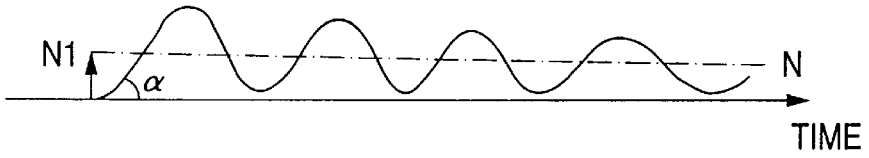
FIG. 18(*a*) is a chart showing the displacement of the meniscus when the first signal is applied.
Figure 18:
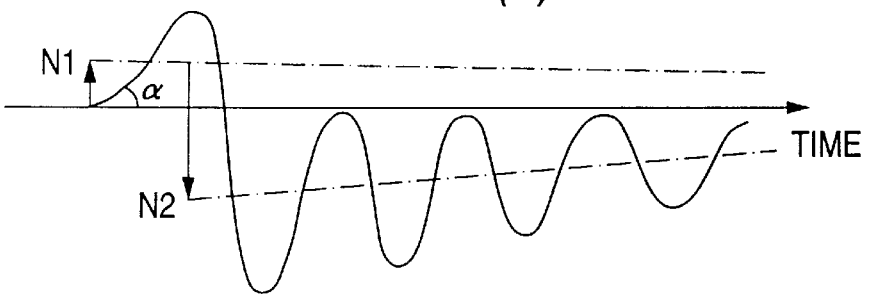
Figure 18:
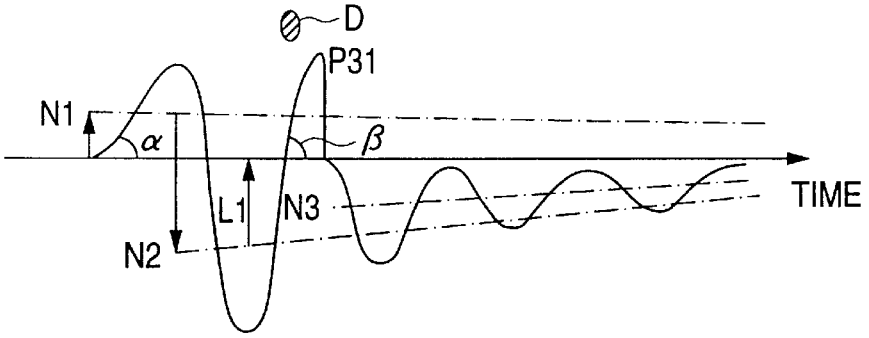
Figure 18:
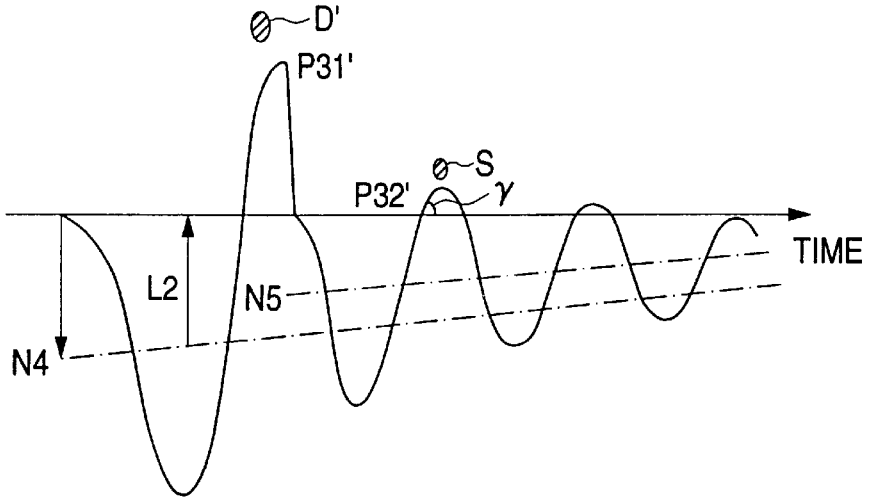

FIG. 18(*a*) shows that the displacement of the meniscus to which the first signal S41 is continuously applied is used as a time reference of the period Tc in terms of the time elapsed after the application of the first signal S41. The meniscus generates the Helmholtz resonance vibration with the period Tc by means of the first signal S41 at a position Ni where the neutral line of the vibration is further pushed up outside from the face of the nozzle opening 6. In this case, the ink droplet is never isolated from the meniscus since the displacement velocity (gradient $\alpha$) is low.

FIG. 18(*b*) shows the displacement of the meniscus when the third signal S43 is applied after the first signal S41 is applied and by applying the third signal S43, the pressure generating chamber 2 is expanded, whereby the neutral line of the vibration is moved from a position Ni to a position N2 on the pressure generating chamber side.

FIG. 18(*c*) shows the displacement of the meniscus when the fifth signal S45 is applied after the first signal S41 up to a fourth signal are applied and the neutral line of the vibration is pushed up, because of the fifth signal S45, from a position N2 to a position in substantially agreement with the face of the nozzle opening (the abscissa in FIG. 18). At this time, the peak P31 of the Helmholtz resonance vibration with the period Tc induced in the meniscus by means of the third signal S43 is swollen up from the face of the nozzle opening. Since the Helmholtz resonance vibration with the period Tc has been superposed on the meniscus thus swollen up by the third signal S43, the displacement velocity (gradient $\beta$) becomes sufficiently raised. Therefore, the peak P31 of the meniscus vibration is isolated from the meniscus and caused to fly up in the form of a very small ink droplet D.

The meniscus is reversed and moved from the face of nozzle opening to the pressure generating chamber 2 after the ink droplet is jetted. Although the meniscus pulled in from the face of the nozzle opening moves its neutral line to a position N3 and vibrates, the meniscus is made to return to the proximity of the face of the nozzle opening by its own surface tension after the passage of sufficient time.

FIG. 18(*d*) shows the vibration of the meniscus when the potential difference of the third signal S43 and that of the fifth signal S45 are set equal while the first signal S41 and the second signal S42 are dispensed with, that is, when signals (FIG. 19) identical with those used in the conventional driving method are applied, wherein the neutral line of the vibration is moved by the signal S1 into the depth position N4 of the pressure generating chamber. When the piezo-electric vibrator is caused to elongate by applying the third signal S3 after the charge voltage by means of the first signal is held for a predetermined length of time, the neutral line of the vibration is returned to the face of the nozzle opening, and the peak P31' of the meniscus vibration swollen up from the face of the nozzle opening is flying up in the form of an ink droplet D'. The meniscus is in such a state that it has been pulled deep from the face of the nozzle opening after the ink droplet is jetted and vibrates by making the neutral line a position N5. However, the swollen-back peak P32' of the meniscus is protruded from the nozzle opening 6 because the amplitude of the Helmholtz resonance vibration is large and because the Helmholtz resonance vibration still continues, and the displacement velocity (gradient $\gamma$) is high, whereby an ink droplet whose quantity of ink is smaller than that of ink for the ink droplet D' is isolated and generated as a satellite S.

On the contrary, since the third signal S43 is used to pull in the neutral line N after the neutral line N is pushed up to the position N1 outside from the face of the nozzle opening by means of the first signal S41 according to this embodiment of the present invention, a pull-up quantity L1 from the face of the nozzle opening becomes smaller than a pull-up quantity L2 from the face of the nozzle opening in the conventional driving method. As the push-up quantity of the meniscus used to jet an ink droplet for printing can be made smaller, the quantity of ink for printing is made reducible by suppressing the displacement velocity of the meniscus and further the amplitude of the residual vibration of the meniscus after an ink droplet is jetted is also made reducible. Thus, it is possible to prevent the generation of a satellite and to shorten the time required to suppress the residual vibration.

According to this embodiment of the present invention, the first signal S41 is used to vibrate the meniscus and the third signal S43 is applied at the point of time the vibration of the meniscus is directed to the inside of the nozzle opening 6, thereupon the vibration energy by means of the first signal S41 is effectively utilizable. In comparison with the conventional driving method in which the meniscus is pulled in from the static state of the meniscus, the amplitude of the residual vibration of the meniscus is also reducible after an ink droplet is jetted since the ink droplet is jettable in such a state that the voltage of the third signal has been lowered, so that the printing speed can be improved while the generation of a satellite is prevented.

Further, the meniscus maintained in the static state is caused to undergo vibration and displacement by pushing up the meniscus to the extent that an ink droplet is not jetted outside the face of the nozzle opening by means of the first signal S41. Further, the third signal S43 is synchronously applied in such a manner as to pull the neutral line of the meniscus into the depth of the nozzle opening in synchronization of the vibration above, whereby the potential difference of the fifth signal S45 used to push up the neutral line N of the meniscus used to jet an ink droplet fit for printing toward the front end of the nozzle opening 6 can be made lower than that of the third signal S43. Thus, the printing speed can be improved while the generation of a satellite is prevented.

Representative data on the driving signals for use in materializing the driving method according to the fourth embodiment of the present invention will be described below. The potential difference of the first signal S41 is within the scope of preventing an ink droplet from being jetted and allowing the meniscus to be effectively vibrated; for example, from 0.2 to 0.5 time the driving voltage of the third signal S43 used to jet an ink droplet. When the potential difference of the first signal S41 is smaller than 0.2 time the driving voltage of the third signal S43, the Helmholtz resonance vibration with the period Tc cannot be induced in the meniscus and the pushingup of the neutral line of the vibration for use in discharging an ink droplet by means of the fifth signal S45 becomes meaningless. Whereas when the potential difference of the first signal S41 is set greater than 0.5 time the driving voltage of the third signal S43, the meniscus in the static state is pushed out at a higher velocity and this results in inadvertently discharging an ink droplet.

Further, the duration T41 of the first signal S41 is set shorter than the period Tc of the Helmholtz resonance vibration and preferably shorter than ½ of the period Tc of the Helmholtz resonance vibration in view of particularly the second signal S42. The duration T42 of the second signal S42 is set so that the length of time (T41+T42) until the termination of application of the second signal S42 from the point of time the first signal S41 is applied is set odd-number times (½Tc, ⅗Tc, ⅕Tc, . . . ) ½ of the period Tc of the Helmholtz resonance vibration, especially set to ½ Tc. By setting the time until the termination of application of the second signal S42 from the point of time the first signal S41 is applied like this, the third signal S43 for positively pulling the meniscus into the depth of the nozzle opening 6 at the point of time the meniscus vibration is directed to the inside of the nozzle opening, so that the small potential difference is usable for the operation of pulling in as the vibration energy of the meniscus can be utilized. The duration T43 of the third signal S43 is set shorter than the period Tc of the Helmholtz resonance vibration in order that the Helmholtz resonance vibration is pulled into the nozzle opening 6 while the Helmholtz resonance vibration is generated to a greater extent and more specifically, the duration thereof is preferably set shorter than the period Tc of the Helmholtz resonance vibration and furthermore less than the natural vibration period of the piezo-electric vibrator 11.

The duration T44 of a fourth signal S44 is set to ½ or less of Tc is set so that the fifth signal S45 is applied in such a manner as to push up the meniscus at the point of time the meniscus vibration is directed toward the outside of the nozzle opening 6. Moreover, the fifth signal S45 is set greater than the period Tc of the Helmholtz resonance vibration so as to push up the neutral line N of the meniscus vibration up to the face of the nozzle opening without causing the Helmholtz resonance vibration superposed on the meniscus to be uselessly generated, and preferably set at the same value as that of the period Tc.

In other words, the first signal S41 is set at 0%–50% of the period Tc; the second signal S42 is set at 0%–50% of the period Tc of the Helmholtz resonance vibration, more particularly, set to 1 μS–2 μS; the third signal S43 is set shorter than the period Tc, preferably set to ½ of Tc; the fourth signal S44 is set at 0%–50% of the period Tc; and the fifth signal S45 is set greater than the period Tc, preferably set substantially equal to Tc to ensure that a satellite is obviated without the vibration of the meniscus.

In order to describe the mode for carrying out the present invention, the above-described embodiments thereof are based on the representative examples tested by the use of an ink-jet recording head with a period Tc of 6 μS and a nozzle opening 6 having a diameter of ϕ26 μm. However, test results similar to those stated above were also obtained from an ink-jet recording head with a period Tc of 4 μS–20 μS and a nozzle opening 6 having a diameter of ϕ20 μm–ϕ40 μm.

Although the piezo-electric vibrator of the vertical vibration mode has been employed according to the above-described embodiment of the present invention, the Helmholtz resonance vibration necessary for discharging an ink droplet may be generated by expanding the pressure generating chamber for a duration of about 2 μS because of small electrostatic capacitance even when use is made of a film-like piezo-electric vibrator in the form of an elastic plate made by sputtering piezo-electric material or an actuator formed with a single board such as a piezo-electric board which is pasted thereon.

Possibility of Industrial Utilization

Since driving voltage to be applied to the piezo-electric vibrator can be set lower, the generation of the Helmholtz resonance vibration with the period Tc by the meniscus is kept to an absolute minimum. Further, an attempt has been made to prevent the generation of a satellite and to shorten the vibration attenuation time by controlling the residual vibration of the period Tc of the Helmholtz resonance vibration of the meniscus whereby to make a very small dot formable at a high driving frequency. Therefore, an ink-jet recording head capable of high-speed printing with substantially the same degree of print quality as photographs is rendered attainable.

What is claimed is:

1. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

expanding or contracting the pressure generating chamber, thereby generating a vibration at the Helmholtz resonance frequency in an ink meniscus in proximity of the nozzle opening; and applying a pressure wave to the vibrating ink meniscus to thrust the meniscus vibration from the nozzle opening, thereby jetting an ink droplet fit for printing from the nozzle opening;

wherein neither the meniscus vibration nor the pressure wave alone possess sufficient energy to produce the ink droplet fit for printing.

2. A method of driving an ink-jet recording head as claimed in claim 1, wherein the ink droplet is jetted as the resonance vibration reaches a peak.

3. A method of driving an ink-jet recording head as claimed in claim 1, further comprising a step of canceling the resonance vibration by generating a vibration with an opposite phase to that of the ink at the nozzle opening.

4. A method of driving an ink-jet recording head as claimed in claim 1, wherein a diameter of the jetted ink droplet is smaller than that of the nozzle opening.

5. A method of driving an ink-jet recording head as claimed in claim 1, further comprising a step of canceling an oscillation imposed on an ink meniscus by generating a pressure wave with opposite phase.

6. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

expanding or contracting the pressure generating chamber, thereby generating, a first pressure wave that produces Helmholtz resonance, wherein, in proximity of the nozzle opening, an ink meniscus oscillates with the period Tc about a neutral line; and imposing a second pressure wave on the oscillating ink meniscus, thereby changing a position of the neutral line, wherein a combination of the Helmholtz oscillation of the ink meniscus and the changing of the position of the neutral line causes an ink droplet fit for printing to be jetted from the nozzle opening.

7. A method of driving an ink-jet recording head as claimed in claim 6, wherein the ink droplet is jetted as a resonance vibration reaches a peak.

8. A method of driving, an ink-jet recording, head as claimed in claim 6, further comprising a step of canceling a resonance vibration by generating a vibration with an opposite phase to that of the ink at the nozzle opening.

9. A method of driving an ink jet recording head as claimed in claim 6, wherein a diameter of the jetted ink droplet is smaller than that of the nozzle opening.

10. A method of driving an ink-jet recording head as claimed in claim 6, further comprising a step of canceling the oscillation imposed on the meniscus by generating a pressure wave with opposite phase.

11. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

a first step of expanding the pressure generating chamber, thereby applying a negative pressure to an ink meniscus proximate to the nozzle opening and causing ink to flow from the ink supply port into the pressure generating chamber, wherein the duration of the first step is set to be not greater than the period Tc, a second step of maintaining the expanded condition, thereby releasing the negative pressure pulling against the ink meniscus, wherein a Helmholtz resonance oscillation with the period Tc is generated in the ink meniscus, and the ink meniscus begins to move toward the nozzle opening, and a third step of causing an ink droplet to be jetted from the nozzle opening by contracting the pressure generating chamber thus expanded, wherein a timing of the contraction is coordinated with the Helmholtz resonance oscillation of the ink meniscus so that the contraction causes the oscillating meniscus to protrude from the nozzle opening, separating the ink droplet from the meniscus.

12. A method of driving an ink-jet recording head as claimed in claim 11, wherein the duration of the first step is set not greater than ½ of the period Tc.

13. A method of driving an ink-jet recording head as claimed in claim 11, wherein the duration of the first step is set shorter than the natural vibration period of the piezo-electric vibrator.

14. A method of driving an ink-jet recording head as claimed in claim 11, wherein the duration of the second step is set not greater than ½ of the period Tc.

15. A method of driving an ink-jet recording head as claimed in claim 11, wherein the duration of the third step is set not less than the period Tc.

16. A method of driving an ink-jet recording head as claimed in claim 11, wherein the duration of the third step is set substantially equal to the period Tc.

17. A method of driving an ink-jet recording head as claimed in claim 11, further comprising a step of canceling a resonance vibration by generating a vibration with an opposite phase to that of the ink at the nozzle opening.

18. A method of driving an ink-jet recording head as claimed in claim 11, wherein a diameter of the jetted ink droplet is smaller than that of the nozzle opening.

19. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

a first step of expanding the pressure generating chamber, thereby applying a negative pressure to an ink meniscus proximate to the nozzle opening, a second step of maintaining the expanded condition of the pressure generating chamber, thereby releasing the negative pressure pulling against the ink meniscus, wherein a Helmholtz resonance oscillation with the period Tc is generated in the ink meniscus, and the ink meniscus begins to move toward the nozzle opening, a third step of contracting the pressure generating chamber with a volumetric change smaller than a volumetric change at the first step, wherein a timing of the contraction is coordinated with the Helmholtz resonance oscillation of the ink meniscus so that the contraction causes the oscillating meniscus to protrude from the nozzle opening, separating an ink droplet from the meniscus, a fourth step of holding constant the volume of the pressure generating chamber, and a fifth step of returning the pressure generating chamber to the original state by contracting the pressure generating chamber.

20. A method of driving an ink-jet recording head as claimed in claim 19, wherein the duration of the first step is set not greater than the period Tc.

21. A method of driving an ink-jet recording head as claimed in claim 19, wherein the duration of the first step is set not greater than ½ of the period Tc.

22. A method of driving an ink-jet recording head as claimed in claim 19, wherein the duration of the first step is set shorter than the natural vibration period of the piezo-electric vibrator.

23. A method of driving an ink-jet recording head as claimed in claim 19, wherein the duration of the second step is set not greater than ½ of the period Tc.

24. A method of driving an ink-jet recording head as claimed in claim 19, wherein the duration of the third step is set not less than the period Tc.

25. A method of driving an ink-jet recording head as claimed in claim 19, wherein the duration of the third step is set substantially equal to the period Tc.

26. A method of driving an ink-jet recording head as claimed in claim 19, wherein the duration of the fifth step is set not greater than the period Tc.

27. A method of driving an ink-jet recording head as claimed in claim 19, wherein the duration of the fifth step is set substantially equal to the duration of the first step.

28. A method of driving an ink-jet recording head as claimed in claim 19, wherein the potential difference of a signal to be applied to the piezo-electric vibrator at the fifth step is set 0.2–0.8 time the potential difference of a signal to be applied to the piezo-electric vibrator at the first step.

29. A method of driving an ink-jet recording head as claimed in claim 19, wherein the length of time from the start of the first step up to the termination of the fourth step is set integer times the period Tc.

30. A method of driving an ink-jet recording head as claimed in claim 19, wherein the length of time from the start of the first step up to the termination of the fourth step is set twice as long as the period Tc.

31. A method of driving an ink-jet recording head as claimed in claim 19, wherein a quantity of ink in the form of an ink droplet is varied by adjusting the duration of the second step.

32. A method of driving an ink-jet recording head as claimed in claim 19, wherein said fifth step cancels the Helmholtz resonance in the ink meniscus by generating a vibration with an opposite phase to that of the ink at the nozzle opening.

33. A method of driving an ink-jet recording head as claimed in claim 32, wherein the duration of said fourth step is used to regulate a timing of the generation of the vibration with the opposite phase.

34. A method of driving an ink-jet recording head as claimed in claim 19, wherein a diameter of the jetted ink droplet is smaller than that of the nozzle opening.

35. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

a first step of expanding the pressure generating chamber, drawing an ink meniscus proximate to the nozzle opening toward the pressure generating chamber, and generating a Helmholtz resonance vibration in the ink meniscus with a period Tc about a neutral line, a second step of continuously expanding the pressure generating chamber at a volumetric change speed lower than that at the first step, drawing the neutral line of the resonance vibration further toward the pressure generating chamber, whereas the period Tc superposed on the meniscus moves toward the nozzle opening due to a natural vibration of the ink meniscus, causing the Helmholtz resonance vibration on the meniscus to protrude from the nozzle opening, thereby separating an ink droplet from the meniscus, and a third step of contracting the pressure generating chamber in the expanded state.

36. A method of drying an ink-jet recording head as claimed in claim 35, wherein the duration of the first step is set shorter than the duration of the second step.

37. A method of driving an ink-jet recording head as claimed in claim 35, wherein the gradient of a signal to be applied to the piezo-electric vibrator at the first step is set greater than the gradient of a signal to be applied at the second step.

38. A method of driving an ink-jet recording head as claimed in claim 35, wherein the sum of the duration at the first step and the duration at the second step is set greater than the period Tc.

39. A method of driving an ink-jet recording head as claimed in claim 35, wherein the duration of the first step is set not greater than ½ of the period Tc.

40. A method of driving an ink-jet recording head as claimed in claim 35, wherein the duration of the first step is set to time not greater than the natural vibration period of the piezo-electric vibrator.

41. A method of driving an ink-jet recording head as claimed in claim 35, wherein the duration of the second step is set not less than the period Tc.

42. A method of driving an ink-jet recording head as claimed in claim 35, wherein the duration of the second step is set twice as long as the period Tc.

43. A method of driving an ink-jet recording head as claimed in claim 35, wherein a quantity of ink in the form of an ink droplet is varied by adjusting speed at the second step of expanding the pressure generating chamber.

44. A method of driving an ink-jet recording head as claimed in claim 35, wherein the duration of the third step is set not less than the period Tc.

45. A method of driving an ink-jet recording head as claimed in claim 35, wherein the duration of the third step is set substantially equal to the period Tc.

46. A method of driving an ink-jet recording head as claimed in claim 35, further comprising a step of canceling a resonance vibration by generating a vibration with an opposite phase to that of the ink at the nozzle opening.

47. A method of driving an ink-jet recording head as claimed in claim 35, wherein a diameter of the jetted ink droplet is smaller than that of the nozzle opening.

48. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

a first step of expanding the pressure generating chamber, drawing an ink meniscus proximate to the nozzle opening toward the pressure generating chamber, and generating a Helmholtz resonance vibration in the ink meniscus with a period Tc about a neutral line, a second step of expanding the pressure generating chamber at a volumetric change speed lower than that at the first step, drawing the neutral line of the resonance vibration further toward the pressure generating chamber, whereas the period Tc superposed on the meniscus moves toward the nozzle opening due to a natural vibration of the ink meniscus, causing the Helmholtz resonance vibration on the meniscus to protrude from the nozzle opening, thereby separating an ink droplet from the meniscus, a third step of holding the pressure generating chamber in an expanded state, attenuating the Helmholtz resonance vibration of the meniscus, and a fourth step of contracting the pressure generating chamber in the expanded state.

49. A method of driving an ink-jet recording head as claimed in claim 48, wherein the duration of the first step is set shorter than the duration of the second step.

50. A method of driving an ink-jet recording head as claimed in claim 48, wherein the gradient of a signal to be applied to the piezo-electric vibrator at the first step is set greater than the gradient of a signal to be applied at the second step.

51. A method of driving an ink-jet recording head as claimed in claim 48, wherein the sum of the duration at the first step and the duration at the second step is set greater than the period Tc.

52. A method of driving an ink-jet recording head as claimed in claim 48, wherein the duration of the first step is set not greater than the natural vibration period of the piezo-electric vibrator.

53. A method of driving an ink-jet recording head as claimed in claim 48, wherein the duration of the second step is set not less than the period Tc.

54. A method of driving an ink-jet recording head as claimed in claim 48, wherein the duration of the second step is set twice as great as the period Tc.

55. A method of driving an ink-jet recording head as claimed in claim 48, wherein the duration of the third step is set not less than the period Tc.

56. A method of driving an ink-jet recording head as claimed in claim 48, wherein the duration of the fourth step is set not less than the period Tc.

57. A method of driving an ink-jet recording head as claimed in claim 48, wherein the duration of the fourth step is set at substantially the same value as that of the period Tc.

58. A method of driving an ink-jet recording head as claimed in claim 48, wherein a quantity of ink in the form of an ink droplet is varied by adjusting speed at the second step of expanding the pressure generating chamber.

59. A method of driving an ink-jet recording head as claimed in claim 48, further comprising a step of canceling a resonance vibration by generating a vibration with an opposite phase to that of the ink at the nozzle opening.

60. A method of driving an ink-jet recording head as claimed in claim 48, wherein a diameter of the jetted ink droplet is smaller than that of the nozzle opening.

61. A method of driving an ink-jet recording head comprising at least one nozzle opening, pressure generating chambers each communicating with reservoirs via ink supply ports and having a Helmholtz resonance frequency with a period Tc, and piezo-electric vibrators for expanding and contracting the respective pressure generating chambers, the method thereof comprising:

a first step of contracting the pressure generating chamber, causing an ink meniscus to swell in the nozzle opening and generating a Helmholtz resonance vibration in the ink meniscus with a period Tc about a neutral line, wherein the contraction and the meniscus vibration possess insufficient energy to produce an ink droplet, a second step of holding the contracted state, maintaining the Helmholtz resonance vibration in the meniscus, a third step of expanding the pressure generating chamber at a point of time when the Heroltz resonance vibration superposed on the meniscus is directed from the nozzle opening toward the pressure generating chamber, thereby amplifying the Helmholtz resonance vibration of the meniscus, a fourth step of holding the expanded state, maintaining the Helmholtz resonance vibration in the meniscus, and a fifth step of contracting the pressure generating chamber to the original state at a point of time when the Helmholtz resonance vibration superposed on the meniscus is directed toward the nozzle opening, pushing the neutral line of the vibration toward nozzle opening and causing the vibration on the meniscus to protrude from the nozzle opening, separating an ink droplet from the meniscus.

62. A method of driving an ink-jet recording head as claimed in claim 61, wherein the duration of the first step is set shorter than the period Tc.

63. A method of driving an ink-jet recording head as claimed in claim 61, wherein the first step is taken to prevent an ink droplet from being jetted at the first step.

64. A method of driving an ink-jet recording head as claimed in claim 61, wherein the duration of the first step is set shorter than ½ of the period Tc.

65. A method of driving an ink-jet recording head as claimed in claim 61, wherein the variation of the potential difference of a signal to be applied to the piezo-electric vibrator at the first step is set 0.2–0.5 time the variation of the potential difference of a signal to be applied to the piezo-electric vibrator at the third step.

66. A method of driving an ink-jet recording head as claimed in claim 61, wherein the duration of the third step is set not greater than ½ of the period Tc.

67. A method of driving an ink-jet recording head as claimed in claim 61, wherein the duration of the third step is set shorter than the natural vibration period of the piezo-electric vibrator.

68. A method of driving an ink-jet recording head as claimed in claim 61, wherein the sum of the duration at the first step and the duration at the second step is set ½ odd-number times the period Tc.

69. A method of driving an ink-jet recording head as claimed in claim 61, wherein the duration of the third step is set to ½ of the period Tc.

70. A method of driving an ink-jet recording head as claimed in claim 61, wherein the duration of the fourth step is set not greater than ½ of the period Tc.

71. A method of driving an ink-jet recording head as claimed in claim 61, wherein the duration of the fifth step is set not less than the period Tc.

72. A method of driving an ink-jet recording head as claimed in claim 61, wherein the duration of the fifth step is set equal to the period Tc.

73. A method of driving an ink-jet recording head as claimed in claim 61, wherein the volumetric change of the pressure generating chamber at the fifth step is set smaller than the volumetric change at the third step.

74. A method of driving an ink-jet recording head as claimed in claim 61, further comprising a step of canceling a resonance vibration by generating a vibration with an opposite phase to that of the ink at the nozzle opening.

75. A method of driving an ink-jet recording head as claimed in claim 61, wherein a diameter of the jetted ink droplet is smaller than that of the nozzle opening.

* * * * *